US011293264B2

(12) United States Patent
Churchill

(10) Patent No.: US 11,293,264 B2
(45) Date of Patent: Apr. 5, 2022

(54) DOWNHOLE APPARATUS AND METHODS

(71) Applicant: Churchill Drilling Tools Limited, Aberdeen (GB)

(72) Inventor: Andrew Philip Churchill, Aberdeen (GB)

(73) Assignee: Churchill Drilling Tools Limited, Aberdeen (GB)

( * ) Notice: Subject to any disclaimer, the term of this patent is extended or adjusted under 35 U.S.C. 154(b) by 471 days.

(21) Appl. No.: 16/471,448

(22) PCT Filed: Dec. 21, 2017

(86) PCT No.: PCT/GB2017/053853
§ 371 (c)(1),
(2) Date: Jun. 19, 2019

(87) PCT Pub. No.: WO2018/115882
PCT Pub. Date: Jun. 28, 2018

(65) Prior Publication Data

US 2021/0131225 A1 May 6, 2021

(30) Foreign Application Priority Data

Dec. 23, 2016 (GB) ..... 1622213

(51) Int. Cl.
*E21B 34/10* (2006.01)
*E21B 21/10* (2006.01)
*E21B 34/08* (2006.01)

(52) U.S. Cl.
CPC ..... *E21B 34/103* (2013.01); *E21B 21/10* (2013.01); *E21B 34/08* (2013.01); *E21B 34/10* (2013.01); *E21B 2200/05* (2020.05)

(58) Field of Classification Search
CPC .... E21B 34/103; E21B 21/10; E21B 2200/05; E21B 34/08; E21B 34/10; E21B 34/00
See application file for complete search history.

(56) References Cited

U.S. PATENT DOCUMENTS 3,071,151 A * 1/1963 Sizer ..... E21B 34/08 137/496
3,481,397 A * 12/1969 Baker ..... E21B 21/10 166/320

(Continued)

FOREIGN PATENT DOCUMENTS

GB 1448765 A 9/1976
WO 2006000799 A2 1/2006

(Continued)

OTHER PUBLICATIONS

Search Report from Application No. GB1622213.5 dated May 8, 2019.

*Primary Examiner* — Yong-Suk (Philip) Ro
(74) *Attorney, Agent, or Firm* — Dinsmore & Shohl LLP

(57) ABSTRACT

Downhole apparatus (30) comprises: a tubular body (42) for incorporation in a tubing string (24); a float valve (30) mounted in the body (42) and operable to prevent flow up though the body; and a float valve retainer (38) maintaining the float valve (30) in an inoperable configuration and permitting flow up through the body (42), the retainer (38) comprising a flow restriction (80) to permit creation of a pressure differential across the restriction (80) and reconfiguring of the retainer (38) to permit operation of the float valve (30). The flow restriction (80) has a retracted configuration and an extended configuration to permit creation of the pressure differential, the flow restriction (80) maintaining the retracted configuration until exposed to a selected absolute pressure.

46 Claims, 27 Drawing Sheets

(56) References Cited

U.S. PATENT DOCUMENTS

| | | | | |
|---|---|---|---|---|
| 3,749,119 | A | 7/1973 | Tausch et al. | |
| 3,826,309 | A * | 7/1974 | Tausch | E21B 34/08 166/319 |
| 4,597,449 | A * | 7/1986 | Keeney | E21B 34/14 166/373 |
| 4,622,993 | A | 11/1986 | Taylor | |
| 7,789,156 | B2 * | 9/2010 | Pia | E21B 34/102 166/332.8 |
| 7,789,229 | B2 * | 9/2010 | Frakes | B25H 3/02 206/350 |
| 9,784,057 | B2 * | 10/2017 | Lloyd | E21B 34/14 |
| 10,435,984 | B2 * | 10/2019 | Mericas | E21B 23/006 |
| 2007/0181188 | A1 * | 8/2007 | Branch | E21B 23/006 137/494 |
| 2013/0075111 | A1 | 3/2013 | Ellis | |
| 2016/0138365 | A1 | 5/2016 | Vick, Jr. et al. | |
| 2017/0356272 | A1 * | 12/2017 | Pinard | E21B 34/10 |

FOREIGN PATENT DOCUMENTS

| | | | |
|---|---|---|---|
| WO | 2013079926 | A2 | 6/2013 |
| WO | 2014140553 | A2 | 9/2014 |
| WO | 2016133539 | A1 | 8/2016 |
| WO | 2016133541 | A1 | 8/2016 |

* cited by examiner

DOWNHOLE APPARATUS AND METHODS

CROSS REFERENCE TO RELATED APPLICATIONS

The present application is a national phase application of PCT/GB2017/053853 filed Dec. 21, 2017, which claims priority to GB1622213.5 filed Dec. 23, 2016. The contents of the above-named applications are incorporated herein in their entirety.

FIELD OF THE DISCLOSURE

This disclosure relates to downhole apparatus and methods. Aspects of the disclosure relate to a check or float valve, and in particular but not exclusively to a check or float valve which may be initially maintained in an inactive or dormant condition and reconfigured to an active condition when desired. Aspects of the disclosure also relate to a hydraulic control or switch which may have utility in downhole operations. Aspects of the disclosure also relate to a downhole apparatus and method, wherein the apparatus is at least partially severed.

BACKGROUND OF THE DISCLOSURE

In the oil and gas exploration and extraction industry, wells are drilled from surface to access subsurface hydrocarbon-bearing formations. The drilling of the bores is typically accomplished by mounting a drill bit on the distal end of a tubular support member, such as a string of jointed drill pipe, which drill pipe string may be thousands of metres long. During a drilling operation drilling fluid, or "mud", is pumped from the surface through the string to cool and lubricate the drill bit, support the wall of the drilled bore, and to carry drill cuttings to the surface, via the annulus between the drill string and the surrounding bore wall. The drilling fluid will normally exit the string through jetting nozzles in the drill bit. During the drilling operation the fluid pressure within the string is normally higher than the pressure in the annulus. However if, for example, the bore intersects a high pressure formation, the pressure in the bore may increase, known as a "kick", and there may be tendency for fluid to flow in an uncontrolled manner up the inside of the drill string. To avoid this possibility, it is currently considered best practice to provide one or more check or float valves within the drill string. These normally-closed valves open to permit flow of fluid down through the string but will remain closed to prevent reverse flow. An example of such a valve in described in U.S. Pat. No. 4,622,993. However, the presence of such a valve prevents the string from "self-filling", that it is not possible for fluid to flow into the string as the string is tripped into the fluid-filled borehole. Accordingly, to prevent collapse of the string due to surrounding hydrostatic pressure, it is necessary to "top-fill" the drill string as it is tripped into the bore, which involves pumping a volume of fluid into the drill string through the open upper end of the string.

To reduce the requirement for top-filing, valves have been developed in which the valves are initially held open. For example, flapper type valves are available in which a sprung latch initially holds the flapper partially open, allowing self-filling. However, as soon as any fluid is pumped through the string, for example, a shallow test of the flow activated tools in the bottom hole assembly (BHA), or to ensure that the jetting nozzles and the drill bit are not blocked, the flapper will open, releasing the latch, such that the flapper closes when the pumps are turned off. The drill string must then be top filled for the remainder of the tripping operation.

Float valves which remain open when fluid is pumped through the string are described in WO 2013/079925 and WO 2014/140553, the disclosures of which are incorporated herein in their entirety. While a drill string incorporating such a valve is being made up and run into a fluid-filled bore, the float valves are initially maintained in an inactive or fully open configuration. This allows the drill string to "self-fill", that is fluid in the bore may flow into the string through the jetting nozzles in the drill bit Pumping fluid through the string does not affect the valves, that is the valves remain fully open. Before drilling commences the float valves are activated, typically by dropping or pumping an activating device into the valve, so that they are available to prevent reverse flow.

SUMMARY OF THE DISCLOSURE

Aspects of the present disclosure relate to downhole apparatus and methods.

An aspect of the present disclosure relates to downhole apparatus comprising:

a tubular body for incorporation in a tubing string;

at least one float valve mounted in the tubular body and operable to prevent flow up though the tubular body; and a float valve retainer maintaining the float valve in an inoperable configuration and permitting flow up through the tubular body until the retainer is exposed to a selected absolute pressure and is reconfigured to permit operation of the float valve.

The float valve retainer may comprise a flow restriction to permit creation of a pressure differential across the restriction and reconfiguring of the retainer to permit operation of the float valve, the flow restriction having an inoperable configuration and an operable configuration to permit creation of the pressure differential, the flow restriction maintaining the inoperable configuration until exposed to the selected absolute pressure.

Another aspect of the present disclosure relates to a downhole method comprising:

(a) running a tubing string part-way into a bore with a float valve in the tubing string maintained in an inoperable configuration and permitting fluid to flow from the bore into the tubing string;

(b) pumping fluid down the tubing string and through the float valve while the valve remains in the inoperable configuration;

(c) exposing the float valve to a selected absolute pressure to reconfigure the float valve to an operable configuration and preventing flaw from flowing from the bore into the tubing string.

The method may be carried out in the order of the steps recited above.

The tubing string may be run or tripped further into the bore between steps (b) and (c).

The method may further comprise:

reconfiguring a flow restriction associated with the float valve from an inoperable configuration to an operable configuration in response to the selected absolute pressure; and pumping fluid down the tubing string to create a pressure differential across the flow restriction and thereby reconfiguring the float valve to the operable configuration.

The tubing string may be run or tripped further into the bore between reconfiguring the flow restriction and pumping fluid down the tubing string to create a pressure differential across the flow restriction.

The method may comprise, at step (c) pumping fluid into the tubing string to increase the pressure in the tubing string to provide the absolute pressure.

Running the tubing string into the bore with the float valve in an inoperable or open configuration allows the tubing string to self-fill and provides the operator with the ability to pump fluid down through the tubing string without activating the float valve. This allows the operator to carry out shallow-hole testing of apparatus mounted in the tubing string without activating the float valve, and to subsequently run the tubing string further into the bore with the tubing string continuing to self-fill.

Typically, at least two float valves will be provided. The float valves may be operated or controlled independently, or may be operated or controlled in combination, for example in combination with a single float valve retainer.

The operative float valve may be normally-closed, and the float valve may be biased towards a closed configuration.

In the closed configuration, flow down through the tubing string will tend to open the valve, whereas flow up though the tubing string is prevented by the closed valve. In the no-flow condition, the float valve remains closed.

In the inoperative configuration, the flow restriction may be retracted, for example the flow restriction may be located or positioned to a side of the tubular body, out of a flow path through the tubular body.

In the operative configuration the flow restriction may extend into a flow path through the tubular body.

Alternatively, or in addition, in the inoperative configuration the flow restriction may be isolated from, or fixed relative to, an element of the float valve retainer, and in the operative configuration the flow restriction may be operatively associated with the element of the float valve retainer. For example, the flow restriction may comprise an activating device such as a ball or dart. In the inoperative configuration the activating device may be fixed or restrained in the tubular body above the float valve, with fluid bypass provided around the activating device. On exposure to the selected absolute pressure the activating device may be released and may then be free to translate to land on a profile or seat operatively associated with the float valve. When the activating device engages the seat a pressure differential may be created across the activating device and seat to translate the seat and reconfigure the float valve. The activating device may subsequently be reconfigured to provide fluid bypass, for example the activating device may be released from the seat and translated to a catcher.

The flow restriction may subsequently be reconfigured from the operative configuration to an inoperative configuration, for example the flow restriction may be reconfigured from an extended configuration to a retracted configuration.

The flow restriction may comprise a valve member, for example a flapper or disc.

In the inoperative or retracted configuration the flapper may extend along an axis parallel to a longitudinal axis of the tubular body.

In the operative or extended configuration the flapper may lie perpendicular to the longitudinal axis of the tubular body.

The flapper may rotate from a first retracted position, to an extended position, and then to a second retracted position. The flapper may pivot downwards between the first retracted position and the extended position, and then pivot further downwards between the extended position and the second retracted position. The float valve retainer may take any appropriate form and may include a member for holding a float valve member off a valve seat and preventing the valve from closing.

The float valve retainer may comprise a retainer member for extending axially of the body, and/or the retainer member may extend along the tubular body bore. The retainer member may be tubular. The retainer member may cooperate with the flow restriction such that a pressure differential across the flow restriction generates a release force on the retainer member. In one example, the extended flow restriction engages an upper end of the retainer member, and the extended flow restriction may close off the upper end of a tubular retainer member. The retainer member may be releasably retained in a first position, and may be movable from the first position to allow the float valve to close. The retainer member may be releasably retained by releasable retainers, such as shear couplings.

The apparatus may further comprise a catcher for receiving the released retainer member.

The float valve retainer may comprise a retaining member for maintaining the float valve in an inoperable configuration, the float valve being operatively associated with a chamber containing compressible fluid. The fluid contained in the chamber may be at a relatively low pressure compared to well bore pressure. The fluid contained in the chamber may be at atmospheric pressure. The fluid may be gas. The fluid may be liquid.

The selected absolute pressure may be a pressure differential sufficient to release and translate the retaining member and compress the compressible fluid contained in the chamber.

Other arrangements for retaining a float valve open or inoperative are described in WO 2013/079926 and WO 2014/140553 and may be adapted for use in combination with the present disclosure.

The float valve retainer may comprise an apparatus for activating a downhole tool as described below.

Another aspect of the disclosure relates to an apparatus for activating a downhole tool, the apparatus comprising a tubular body for incorporation in a tubing string, the tubular body having a chamber with an initial sealed volume defined at least in part by a wall member and configured to contain a compressible fluid at a first pressure, the wall member being moveable on exposure of the apparatus to a second pressure higher than the first pressure and creating a pressure differential above a predetermined magnitude to reduce the volume of the chamber.

The tubular body may be suitable for incorporation in a drill string, tool string or completion string. The tubular body may include appropriate end couplings, for example threaded end couplings.

Another aspect of the disclosure relates to a downhole method comprising:

(a) providing apparatus having a tubular body and a wall member;

(b) releasably restraining the wall member relative to the tubular body to define a sealed chamber having an initial volume and containing compressible fluid at a first pressure;

(c) running the apparatus into a bore; and (d) generating a second pressure in the bore higher than the first pressure to create a pressure differential across the wall member and a resultant force sufficient to release the wall member and move the wall member relative to the tubular body to reduce the volume of the chamber.

The wall member may take any appropriate form. The wall member may comprise a sleeve axially translatable relative to the tubular body. The sleeve may be provided internally of the tubular body. The sleeve may define part of a through bore of a tubing string.

The chamber may be of any suitable shape or form and may, for example, be annular. The chamber may be defined by an axially extending surface of the tubular body, a laterally extending surface of the tubular body, an axially extending surface of the wall member, and a laterally extending surface of the wall member.

The chamber may contain low pressure gas, such as air, which gas may initially be at atmospheric pressure; the chamber may be sealed at surface.

Alternatively, the chamber have been evacuated, and may initially contain a vacuum or partial vacuum.

Alternatively, or in addition, the chamber may contain a liquid, for example water or oil. The liquid may serve to provide hydraulic damping or act as a brake as the wall member moves to reduce the volume of the chamber. Alternatively, or in addition, other damping or braking arrangements may be provided, for example, movement of the wall member may be associated with displacement of a liquid through a flow restriction.

The wall member may be releasably retained relative to the tubular body by any suitable arrangement, for example releasable couplings, which couplings may be shear couplings such as shear pins, or sprung or otherwise biased couplings. In one example, a combination of shear pins may be provided and the shear strengths of the individual shear pins may combine to provide a predetermined release force for the apparatus. The shear couplings may be provided in combination with a spring which protects the shear couplings from loading until the spring force has been exceeded. The spring may be provided within the chamber. Alternatively, or in addition, the wall member may be releasably retained by a coupling which disengages or releases in response to a control input or signal. For example, the coupling may release in response to the presence or absence of fluid flow through the body, or a pressure signature. In another example, the wall member may be releasably retained by a coupling which releases after a timed interval.

The wall member may be released in response to exposure of the apparatus to an elevated second pressure. The elevated pressure may be, for example, hydrostatic pressure or pump-generated pressure, or a combination of both. The hydrostatic pressure may be related to the depth of the apparatus in the bore, and the density of the fluid in the bore. Thus, an operator may determine that the wall member will move once the apparatus has been run into a well bore to a predetermined depth. The hydrostatic pressure at this depth will be known and the apparatus may be configured such that the wall member will move on experiencing the associated differential pressure between the surrounding hydrostatic pressure and the pressure in the chamber: Alternatively, the operator may use pumps to increase the fluid pressure in the bore above hydrostatic pressure. This facilitates activation of the apparatus without the requirement to deploy an activating device, such as a ball or dart, into the tubing string. Thus, the apparatus may still be activated in situations where it not possible to drop or pump an activating device into a string, for example in a horizontal well section where the bore has become plugged off and it is not possible to circulate fluid through the string to push a ball or dart along the horizontal string section. Also, without the requirement for passage of an activating device from surface to activate the apparatus there is greater flexibility in the location of the apparatus in a string. For example, the apparatus may be located below tools or devices which would prevent or restrict the passage of an activating device, for example an MWD or LWD tool. Examples of the disclosure may also be useful in situations where it is desired to maintain the string bore free of activating devices or other obstructions. Thus, the apparatus may be located above tools or devices which themselves require subsequent activation by a ball or dart, such as a ball-activated under-reamer.

The wall member may act as a detent, for example retaining another member in an initial position, or otherwise restricting or limiting movement of another member, until the wall member moves. The other member may be biased from the initial position, and may move from the initial position immediately the wall member moves, or may require an additional input to move from the initial position. The other member may be an extendable member, or may be coupled to or otherwise operatively associated with an extendable member, and may be maintained in a retracted position, to be released for movement towards an extended position when the wall member moves. The extendable member may be a valve member. If serving as a detest, the wall member may only be required to move a short distance, for example less than 10 cm, less than 5 cm, less than 3 cm, less than 2 cm, or less than 1 cm.

The wall member may comprise or be coupled to or operatively associated with an operating member, whereby movement of the operating member changes the configuration or operation of a tool or device. For example, the operating member may be a valve member and the valve member may be moved from a port-closing position to a port-opening position. The valve may be provided in a by-pass or circulating tool. The wall member may block or connect fluid passages, and may be moved to connect or block the passages. The operating member may be directly coupled to the wall member such that the extent of movement of the operating member corresponds to the movement of the wall member, or the operating member and the wall member may be coupled by a movement or force multiplier linkage, for example a geared linkage. Alternatively, the operating member may be moved an initial distance by the wall member and then moved further by other means. For example, the operating member may be spring-biased to move but may be initially restrained by a shear coupling; an initial movement provided by the wall member may shear the coupling and then permit the operating member to move further under the influence of the spring.

The wall member may be arranged provide a force or impulse to operate a tool or device. For example, the wall member may be associated with a cutting tool and may provide a cutting or shearing force. In one example, the wall member may be associated with a cutting blade of a hard material such as a ceramic and the cutting blade may be arranged to sever a portion of a tubing string.

The wall member may have a mass and be arranged to accelerate after release to generate a momentum or kinetic energy which may be utilised directly or may be transferred to another member.

Another aspect relates to an apparatus for activating a downhole tool, the apparatus comprising a tubular body for incorporation in a tubing string, the tubular body having a chamber with an initial sealed volume and defined at least in part by a wall member and configured to contain a compressible fluid at a first pressure, the wall member being moveable on exposure of the apparatus to a second pressure higher than the first pressure and creating a pressure differential above a predetermined magnitude to reduce the volume of the chamber.

The wall member may comprise a sleeve axially translatable relative to the tubular body. The sleeve may be provided internally of the tubular body. The sleeve may define part of a throughbore of the tubing string.

The chamber may be annular. The chamber may be defined by an axially extending surface of the tubular body, a laterally extending surface of the tubular body, an axially extending surface of the wall member, and a laterally extending surface of the wall member.

The fluid contained in the chamber may be at a relatively low pressure compared to well bore pressure. The fluid contained in the chamber may be at atmospheric pressure. The fluid may be gas. The fluid may be liquid.

The wall member may be releasably retained relative to the tubular body.

The wall member may be releasably retained relative to the tubular body by a releasable coupling.

The wall member may be releasably retained relative to the body by shear couplings.

The wall member may be releasably retained relative to the body by a combination of shear couplings, the shear strengths of the individual shear couplings combining to provide a predetermined release force for the apparatus.

The shear couplings may be provided in combination with a resilient member, e.g. a spring. The resilient member, e.g. spring, may protect the shear couplings from loading until the spring force has been exceeded.

The wall member may be released for movement in response to exposure of the apparatus to an elevated pressure.

The apparatus may further comprise a flow restriction. The wall member serves as a detent for the flow restriction. The flow restriction may be retained in a retracted position by the wall member and may be biased to move to an extended position on movement of the wall member.

The apparatus may comprise a cutting implement. The cutting implement may be operatively associated with the wall member. The apparatus may be configured such that movement of the movable member translates the cutting implement into the body to at least partially sever the body.

The apparatus may comprise an activating device configured to allow exposure of the wall member to the second pressure.

The apparatus may further comprise a secondary activation mechanism. The secondary activation mechanism may be configured to prevent accidental release of the wall member. Wherein the secondary activation mechanism may be configured to be activated by an activating device, the activating device may be the same activating device used to allow exposure of the wall member to the second pressure.

The secondary activation mechanism may comprise a lock. The lock may be configured to be unlocked by the activating device. The lock may comprise a mechanical lock.

The secondary activation device may comprise a seat. The seat may be sized to restrict passage through the apparatus to the activating device.

Another aspect relates to a downhole method comprising:

(a) providing apparatus having a tubular body and a wall member;

(b) releasably restraining the wall member relative to the tubular body to define a sealed chamber having an initial volume and containing compressible fluid at a first pressure;

(c) running the apparatus into a bore;

(d) generating a second pressure higher than the first pressure in the bore to create a pressure differential across the wall member and a resultant force sufficient to release the wall member and move the wall member relative to the tubular body to reduce the volume of the chamber.

The method may comprise incorporating the tubular body in a tubing string, such as a drill string.

The method may comprise, at step (d), axially translating the wall member relative to the tubular body.

The method may comprise initially filling the chamber with air at atmospheric pressure.

The method may comprise initially partially filling the chamber with liquid.

The method may comprise releasably retaining the wall member relative to the body using releasable couplings.

The method may comprise retaining the wall member relative to the body using shear couplings.

The method may comprise selecting a combination of shear couplings, whereby the shear strengths of the individual shear couplings pins combine to provide a predetermined release force for the apparatus.

The second pressure may comprise hydrostatic pressure. The second pressure may comprise a combination of hydrostatic pressure and pump-generated pressure. The second pressure may comprise pump-generated pressure.

The method may comprise determining a depth in the bore where step (d) is to be initiated and configuring the apparatus to release the wall member on exposure to the hydrostatic pressure occurring at the determined depth.

The method may comprise configuring the apparatus to release the wall member in response to a select pressure differential and, at step (d), generating the selected pressure differential as a combination of hydrostatic pressure and pump pressure.

The method may comprise, following step (d), deploying an activating device into the string and passing the activating device through the apparatus.

The method may comprise carrying out step (d) without circulating fluid through the string.

The wall member may retain a flow restriction in a retracted configuration and, following step (d), the flow restriction may be released to move to an extended configuration.

The method may comprise, before step d) deploying an activating device in the tubing string to engage an activating profile.

The method may further comprise passing the activating device through a secondary activation mechanism sized to restrict passage through the apparatus to the activating device.

Another aspect relates to a drilling operation comprising:

(a) providing a drill string assembly comprising a float valve, an under-reamer and a drill bit:

(b) tripping the assembly at least part way into a bore with the float valve in an inoperative configuration in which flow is permitted both up and down through the valve;

(c) pumping fluid down through the assembly while maintaining the float valve in the inoperative configuration;

(d) reconfiguring the float valve to an operative configuration in which flow down through the valve is permitted but flow up through the valve is prevented;

(e) commencing drilling with the drill bit; and (f) translating an activating device through the drill string to activate the under-reamer.

The method may comprise locating the float valve above the under-reamer in the drill string assembly. Thus, the method may comprise translating the activating device through the float valve, which float valve may have been previously reconfigured.

The method may comprise locating the float valve below the under-reamer.

Another aspect relates to a downhole method comprising:

(a) running a tubing string incorporating a float valve and a float valve retainer into a fluid-filled bore with the float valve retainer maintaining the float valve in an open configuration and permitting fluid to flow up through the tubing string so that the tubing string self-fills; and (b) increasing the pressure within the tubing string above a predetermined level to reconfigure the float valve retainer and permit the float valve to close and prevent fluid from flowing up through the tubing string.

Another aspect relates to a downhole apparatus comprising:

a tubular body comprising a float valve and a float valve retainer for maintaining the float valve in an open configuration, the float valve retainer being reconfigurable in response to an increase in absolute fluid pressure within the tubular body to permit the float valve to close.

The float valve retainer may reconfigure in response to hydrostatic pressure, for example as the apparatus is run into a wellbore. An operator may choose to reconfigure the retainer when a tubing string incorporating the float valve and the float valve retainer is being run into a wellbore and the float valve reaches a certain depth in the bore; the float valve retainer may be set to reconfigure at a hydrostatic pressure corresponding to the selected depth. If it is desired to reconfigure the float valve retainer earlier, that is before the retainer reaches the selected depth, the operator may pump fluid into the tubing string and thereby increase the pressure within the tubing string sufficient to reconfigure the retainer. Thus, the retainer may be reconfigured through a combination of hydrostatic and pump pressure.

Another aspect relates to a downhole method comprising:

(a) running a tubing string incorporating a float valve and a float valve actuator into a fluid-filled bore with the float valve in an open configuration to permit the tubing string to self-fill and with the float valve actuator in an inactive configuration;

(b) pumping fluid from surface down through the tubing string and the float valve and maintaining the float valve in the open configuration;

(c) reconfiguring the float valve actuator from the inactive configuration to an active configuration while continuing to maintain the float valve open;

(d) running the tubing string further into the bore with the float valve in the open configuration to permit the tubing string to continue to self-fill; and (e) pumping fluid from surface down through the tubing string to operate the valve actuator and reconfigure the float valve to a closed configuration in which fluid may be pumped down through the tubing string but is prevented from flowing up through the tubing string.

The methods may be carried out in the order of the steps as recited above, or in an alternative sequence.

Another aspect relates to a downhole apparatus comprising:

a tubular body for location in a tubing string;

a float valve mounted in the tubular body and comprising a valve retainer, the float valve having an open configuration in which the valve permits both downwards and upwards fluid flow through the tubular body and a closed configuration in which the valve permits downwards flow and at least restricts upwards flow, both the open and closed configurations of the float valve permitting downwards passage of a tool through the tubular body, the valve retainer having a first configuration for maintaining the float valve in the open configuration, and a second configuration for permitting the float valve to assume the closed configuration, the valve retainer configuration changing in response to fluid pressure within the tubular body.

Another aspect relates to a downhole apparatus comprising:

a tubular body for location in a tubing string;

a float valve mounted in the tubular body and having an open configuration in which the valve permits both downwards and upwards fluid flow through the tubular body and a closed configuration in which the valve permits downwards flow and at least restricts upwards flow; and a flow or differential pressure-operated valve actuator mounted in the tubular body for changing the configuration of the float valve, the valve actuator having a first inactive configuration in which the valve actuator permits both downwards and upwards fluid flow through the tubular body and an active configuration in which the valve actuator permits upwards flow and at least restricts downwards flow, and a second inactive configuration in which the valve actuator permits at least downwards flow, the apparatus being configurable with: the float valve in the open configuration and the valve actuator in the first inactive configuration; the float valve in the open configuration and the valve actuator in the active configuration; and, following operation of the valve actuator, the float valve in the closed configuration and the valve actuator in the second inactive configuration.

The apparatus may be configured so that fluid pumped from surface travels down through the tubular string, the open float valve, and the inactive float valve actuator.

The first and second configurations may coincide, or may be different.

The valve actuator may have a first retracted configuration corresponding to the first inactive configuration, an extended configuration corresponding to the active configuration, and a second retracted configuration corresponding to the second inactive configuration. In the retracted configurations the valve actuator may leave a substantially clear bore or passage through the tubular body. In the extended configuration a portion of the valve actuator may extend into or across a body bore and may restrict passage through the tubular body.

The valve actuator may comprise a flow-restricting member operatively associated with a valve actuation member, the flow-restricting member having a first retracted configuration, an extended configuration, and a second retracted configuration, in the extended configuration the flow-restricting member creating a flow restriction, at least to downwards flow, and permitting the creation of a fluid pressure differential across the flow-restricting member and generation of an actuating force on the valve actuation member.

The flow-restricting member may comprise a valve member, such as a flapper valve. The valve member may be one piece or may have two or more pieces. The valve member may be pivotally mounted relative to the body. In the retracted configuration the valve member may lie in a plane substantially parallel to a longitudinal axis of the body and in the extended configuration the valve member may lie in a plane substantially perpendicular to the longitudinal axis of the body.

The valve actuator may be retained in the initial inactive configuration and on release the valve actuator may move to the active configuration. The valve actuator may be biased towards the active configuration, and may be biased towards the second inactive configuration. Alternatively, or in addition, the valve actuator may be driven between the different configurations.

The valve actuation member may take any appropriate form. The valve actuation member may initially retain the float valve in the open configuration. The float valve may comprise a valve member and the valve actuation member may initially retain the valve member in a retracted or open position. The valve actuation member may be reconfigurable to allow the valve member to close. In one embodiment the valve actuation member may be a tubular member and may initially extend at least partially through the float valve. The valve actuation member may be translated through the float valve to allow the float valve to be moved to the closed configuration.

The valve actuation member may be releasably retained in an initial position, for example by releasable retainers such as shear pins.

The float valve may take any appropriate form and may comprise one or more valve members. The float valve may comprise one or more flapper valves or one or more poppet valves.

In the closed configuration the float valve may be normally closed, that is in the absence of external influences the float valve tends to remain closed, and will prevent upwards flow. Downwards flow, and the resulting pressure differential across the valve, may open the valve. Similarly, the valve may be opened by passage of device or tool downwards though the valve.

The apparatus may comprise a valve actuator retainer for retaining the valve actuator in the initial inactive configuration. The retainer may be operable to release the valve actuator. The retainer may comprise a switch, which switch may operate autonomously or may be operated by operator action. The switch may be a pressure switch and may operate in response to tool bore pressure. The tool bore pressure may be hydrostatic pressure or a combination of hydrostatic pressure and generated or pump pressure. Alternatively or in addition, the switch may operate in response to differential pressure.

The valve actuator retainer may comprise a retainer member which is translatable in response to fluid pressure forces. The retainer member may comprise a piston operatively associated with a chamber, which chamber may initially contain fluid at relatively low pressure, for example air at atmospheric pressure. When the tool is run into a fluid-filled bore the relatively high hydrostatic pressure in the bore may tend to urge the piston to move into or through the chamber. The retainer member may be initially fixed relative to a body defining the chamber. The retainer member may be fixed relative to the body by a releasable retainer such as a shear pin. The releasable retainer may be selected to fail or shear in response to a predetermined pressure differential. The predetermined pressure differential may be achieved by running the valve actuator to a predetermined depth in the bore, where the valve actuator will experience a predictable hydrostatic pressure.

The valve actuator retainer may comprise a sleeve having an external shoulder defining a piston, the sleeve being axially movable in a body and the sleeve and body collectively defining an annular chamber.

Another aspect relates to a downhole hydraulic switch comprising a body and a movable member, the body and the member collectively defining a chamber having an initial volume, whereby an elevated external pressure causes the member to move and the volume of the chamber to decrease.

The hydraulic switch may be provided in a tubing string and may be configured to release a component of a downhole apparatus from an inoperable configuration to permit operation of the component, when exposed to the elevated pressure.

The elevated pressure may comprise external pressure, for example hydrostatic pressure. The elevated pressure may comprise internal pressure, for example, pressure generated by pumping from surface. The elevated pressure may comprise a combination of external pressure and internal pressure.

The hydraulic switch may be provided in combination with a float valve, wherein the movable member is configured to maintain the float valve in an inoperable configuration, which permits flow up through the tubular body.

The movable member may take the form of a float valve retainer, or a flow restriction retainer, wherein, the float valve comprises a flow restriction.

The hydraulic switch may be provided in combination with a cutting tool, for example, the movable member may operatively associated with a cutting implement such that as the volume of the chamber decreases, a cutting or shearing force is generated which acts on the body.

The hydraulic switch may be provided in combination with one or more secondary activation mechanisms configured to prevent the accidental movement of the movable member to decrease the volume of the chamber.

The secondary activation mechanisms may comprise an activation profile configured to engage with an activation device which is released from surface. The activation profile may be configured such that only the appropriate activation device can seal in the profile and allow exposure of the movable member to the elevated pressure. For example, the activation profile may be provided with vents or bypass channels such that in the event of another, incorrectly sized member landing on the profile, the incorrectly sized member will not fully restrict flow through the profile, preventing the movable member being exposed to the elevated pressure.

The secondary activation mechanisms may additionally, or alternatively, comprise a profiled seat which is configured to restrict access to the hydraulic switch to an activation device. For example, the profiled seat may allow the activation device to pass through the seat to engage an activation profile. The profile seat may prevent any members having a larger size than the activation profile from passing through the seat.

The secondary activation mechanism may additionally or alternatively, comprise a mechanical safety mechanism which is configured to be unlocked by an activation device to allow the movable member to move when exposed to the elevated pressure. For example, the mechanical safety mechanism may be configured such that an incorrectly sized member would not unlock the mechanism and therefore, the movable member would be prevented from moving to reduce the volume of the chamber.

Another aspect relates to a downhole method comprising:

providing in a tubing string a body and a movable member collectively defining a chamber having an initial volume; and running the tubing string into a fluid-filled bore, whereby fluid pressure in the bore causes the member to move to decrease the volume of the chamber.

Movement of the member may be utilised to actuate or activate a downhole tool or device.

The movable member may reconfigure a float valve from an inoperable configuration to an operable configuration.

The movable member may be operably associated with a cutting implement such that as the volume of the chamber decreases, a cutting or shearing force is generated which acts on the body.

The chamber may be initially sealed. The chamber may initially contain compressible fluid, such as gas or air. The fluid may be at a relatively low pressure, for example at atmospheric pressure.

The fluid pressure in the bore may be hydrostatic pressure or a combination of hydrostatic pressure and generated pressure. Alternatively or in addition, the switch may operate in response to differential pressure.

The movable member may comprise a piston operatively associated with the chamber. Thus, when the switch is run into the fluid-filled bore the relatively high hydrostatic pressure in the bore may tend to urge the piston to move into or through the chamber. The movable member may be initially fixed relative to the body. The member may be fixed relative to the body by a releasable retainer such as a shear pin. The releasable retainer may be selected to release in response to a predetermined pressure differential. The predetermined pressure differential may be achieved by running the switch to a predetermined depth in the bore, where the switch will experience a predictable hydrostatic pressure. The predetermined pressure differential may be achieved by pressure generated from surface, for example by a pump.

The movable member may comprise a sleeve having an external shoulder defining a piston, the sleeve being axially movable in a body.

The method may further comprise translating an activating device through one or more secondary mechanisms, wherein the secondary mechanisms are configured to prevent activation of the hydraulic switch.

Another aspect relates to a downhole apparatus comprising:

a body;

a movable member configured to be moved relative to the body, wherein in a first configuration of the apparatus, the body and the movable member define a chamber configured to contain a fluid at a first pressure;

the movable member being movable upon exposure of the apparatus to a second pressure higher than the first pressure, to reconfigure the apparatus to a second configuration in which the body is at least partially severed.

The apparatus may be configured to utilise the movement of the movable member to generate an impact force on the body to at least partially sever the body. In the second configuration, the chamber may be reduced in volume.

In the second configuration, the body may be over-stressed by an external hydrostatic pressure to at least partially sever the body. When the hydrostatic pressure is above a collapse pressure of the body, this exposure to hydrostatic pressure may result in at least partial severing of the body.

In the second configuration, the chamber volume may be increased and the compressible fluid may be maintained at the first pressure, wherein a portion of the chamber having the increased volume is configured to be over-stressed by an external hydrostatic pressure which is higher than the first pressure.

The first pressure may be a relatively low pressure compared to well bore pressure. The first pressure may be atmospheric pressure.

The second pressure may be, for example, hydrostatic pressure. The second pressure may be a combination of hydrostatic pressure and generated pressure, for example, pump generated. The second pressure may be generated pressure, for example pump generated pressure.

As used herein, at least partially severed encompasses, for example but not limited to the body being cut, the body being damaged, and the body being separated into two or more parts. Over-stressed may comprise stressing the body beyond the body's elastic limit. Over-stressing may also encompass, but not limited to the body buckling, the body being distorted, the body being damaged and the body at least partially severing.

The apparatus may comprise a second chamber. The second chamber may be configured to be exposed to fluid in the bore at, at least, hydrostatic pressure. The second chamber may have a first arrangement in which the second chamber is open. In the first arrangement of the second chamber, the chamber may be open and in fluid communication with fluid in the bore.

The second chamber may have a second arrangement in which the second chamber may be sealed. The second chamber in the second arrangement may contain a fluid at a pressure, which is higher than the first pressure. The pressure of the fluid contained by the second chamber in the second arrangement may be at least hydrostatic pressure.

The second chamber may be sealed using an activating device, for example, a ball, dart, plug or any appropriate device. The activating device may be dropped from surface and configured to land on an activating profile.

The apparatus may be configured to be activated to reconfigure the apparatus from the first configuration to the second configuration.

Activation may comprise movement of the movable member and movement of the movable member may be initiated by exposing the movable member to a second pressure higher than the first pressure. This may by facilitated using an activating device. The activating device may be any appropriate activating device, for example a dart, a plug, a ball or the like. The activating device may and on an activating profile. Pressure may be applied from above to increase the pressure above a pre-determined value wherein the movable member is translated.

A single activating device may be used to seal the second chamber and allow for exposure of the apparatus to the second pressure.

The second chamber may comprise a portion which is configured to be over-stress when exposed to an external hydrostatic pressure above a pre-determined value. For example, the second chamber may comprise an outer wall which may comprise a relatively thinner portion than other portions of the wall. The outer wall of the second chamber may be defined by the body. The external hydrostatic pressure above a pre-determined value may be defined by the collapse pressure of outer wall. The collapse pressure may be determined by the materials of construction of the body and/or the diameters selected to form the body. The outer wall may be over-stressed radially inwards upon exposure to external hydrostatic pressure above a pre-determined value, wherein the body is at least partially severed.

In an arrangement of the apparatus, movement of the movable member may reconfigure the second chamber from the second arrangement to a third arrangement in which the second chamber is in fluid communication with the first chamber. Since the first chamber contains fluid at a first pressure, which is less than the pressure of the fluid in the second chamber in the second configuration, when the first and second chamber are brought into fluid communication, the pressure of the fluid within the first and second chambers may equalise at the first pressure. The second chamber in the third arrangement may correspond to the second configuration of the body.

When the body comprises two chambers, the movable member may be defined by a movable valve member, wherein the movable valve member may be moved to allow fluid communication between the two chambers, for example the valve member may be opened to allow fluid communication between the two chambers. Movement of the movable valve member may be initiated by a signal, for example, a remote signal from surface.

With the second chamber in the third arrangement, over-stressing the second chamber may occur if the external hydrostatic pressure exceeds the pre-determined value. This over-stressing may result in at least partial severing of the body.

An additional force, for example pulling and/or torque, may be further utilised to sever the body if required.

The apparatus may comprise a cutting implement. The cutting implement may be located within the second chamber. The cutting implement may take the form of, for example, a singular knife, a circular knife, or any appropriate form of knife. The cutting implement may be positioned such that when the second chamber is in the third arrangement, the cutting implement may piece through the second chamber. This may facilitate at least partial severing of the apparatus. For example, the cutting implement may pierce through the outer wall of the second chamber as the outer wall over-stresses inwards The apparatus may be configured for incorporating into a tubing string. The apparatus may be configured such that at least partial severing of the body facilitates severing of the tubing string.

The movable member may be initially fixed relative to the body. The member may be fixed relative to the body by a releasable retainer such as a shear pin. The releasable retainer may be selected to release in response to a predetermined pressure differential.

The predetermined pressure differential may be achieved by pressure generated from surface, for example pump generated pressure. The predetermined pressure differential may be selected to be greater than an expected hydrostatic pressure when in use downhole.

The chamber may be initially sealed and retained at the first pressure, for example atmospheric pressure. The volume of fluid within the at least one chamber may be utilised to provide power to sever the apparatus.

As the apparatus is run in hole, the chamber may be retained at the first pressure, while hydrostatic pressure internally and externally to the apparatus increases. The apparatus may be configured such that the difference in pressure between the outside of the movable member and the inside of the movable member acts on the cross sectional area of the movable member. The movable member may comprise a sleeve. The cross-sectional area may therefore be the annular cross-sectional area of the sleeve.

The movable member has a mass and may be arranged to accelerate to at least partially sever the apparatus. The movable member has a mass and may be arranged to accelerate upon exposure to the second pressure to reduce the volume of the at least one chamber. The energy created by the release of the movable member may be proportional to the length of travel of the movable member. The length of travel of the movable member may be defined by the length of the at least one chamber.

The body may be arranged to provide a stop for the movable member. The stop may be defined by an end of the at least one chamber. As the movable member is translated, the movable member will travel into the stop, and the energy generated by the release of the movable member will generate an impact force. The impact force may be sufficient to at least partially sever the body.

The apparatus may further comprise a cutting implement which may be operatively associated with the movable member. In the second configuration of the body, as the movable member is translated, the cutting implement may be translated into the body such that cutting implement pierces the body. The cutting implement may comprise a knife, for example, a circular knife, a singular knife or any form of piercing arrangement. The cutting implement may be arranged to be translated axially and/or radially.

In arrangements of the apparatus where an activating device is utilised to allow exposure of the movable member to the second pressure, the activating profile upon which the activating device is configured land may be positioned above or below the at least one chamber. When the activating profile is located below the at least one chamber, the fluid located in a throughbore of the apparatus may contribute to the force applied to the movable member, and therefore the resulting impact force of the movable member. When the activating profile is located above the at least one chamber, the fluid located in the throughbore of the apparatus may have a damping effect on the activating device.

Alternative forms of activation are also envisaged. For example, the apparatus may be activated using a signal, for example RFIDs, pressure pulses, accelerometers, or any form of remote signals suitable for use in activating downhole tools. These may be used alternatively to or in combination with an activation device to activate the tool.

The apparatus is configured to co-operate with a selected activation device such that the apparatus may only be reconfigured from the first configuration to the second configuration using the selected activation device. The selected activating device may be specifically configured to co-operate, for example, via engagement with a corresponding specifically designed activating profile to allow reconfiguration of the apparatus. The apparatus may be configured such that no other activating device, other than the selected activating device, allows for reconfiguration of the apparatus. As such, inadvertently severing the body may be prevented.

The apparatus may further comprise a further activation mechanism. The further activation mechanism may be configured to prevent inadvertent movement of the movable member. In use, the forces generated by the apparatus as the movable member is translated may be significant and therefore it may be desirable to provide a mechanism which could prevent accidental activation of the apparatus, and hence accidental severing of the apparatus, and any tubing string into which the apparatus is incorporated.

The apparatus may comprise a profile which is sized to limit passage through the apparatus to activating devices of a pre-determined size. The profile may be sized to restrict passage to only the activating device.

The apparatus may comprise a locking device. The locking device may be configured to be operatively associated with the movable member. The locking device may be configured such that the device will be unlocked by an appropriately sized activating device. The activating device may be the same activating device used for allowing exposure of the apparatus to the second pressure. The locking device may comprise a mechanical locking device, for example a retaining collet arrangement. The retaining collet may comprise collet fingers which are biased to retain the movable member in the initial position until an activating device lands on a collet seat. The retaining collet may be configured to release the movable member when the activating device land on the collet seat in combination with a selected generated pressure.

The activating profile may comprise a vented activation profile. The vented activation profile may be configured such that only the activating device will seal on the profile to allow exposure of the apparatus to the second pressure. The vented activation profile may comprise at least one vent and/or at least one bypass channel. If an activation device which was riot the correct activation device, for example an activating device having the same diameter as the correct activating device, but a different shape, would not seal with the activation profile because of the at least one vent and/or bypass channel provided in the profile.

The apparatus may, for example comprise several further activation mechanisms.

Another aspect relates to a downhole method comprising:

providing in a tubing string an apparatus in a first configuration, wherein the apparatus comprises a body and a movable member configured to be moved relative to the body and a chamber configured to contain a fluid at a first pressure; the movable member being movable on exposure of the apparatus to a second pressure higher than the first pressure; and exposing the apparatus to the second pressure to move the movable member and reconfigure the apparatus to a second configuration in which the body is at least partially severed.

The method may comprise utilising the movement of the movable member to generate an impact force on the body to at least partially sever the body.

In the second configuration, the body may be over-stressed by an external hydrostatic pressure to at least partially sever the body.

The method may comprise reconfiguring the apparatus to the second configuration by increasing the volume of the chamber whilst maintaining the compressible fluid at the first pressure, wherein a portion of the chamber having the increased volume is over-stressed by an external pressure which is higher than the first pressure.

The first pressure may be a relatively low pressure compared to well bore pressure. The first pressure may be atmospheric pressure. The second pressure may be one of: hydrostatic pressure, generated pressure, or the combination of hydrostatic and generated pressure.

The method may comprise translating an activating device to land on an activating profile to allow exposure of the apparatus to the second pressure.

The method may comprise reconfiguring a second chamber from first arrangement in which the second chamber open, to a second arrangement, wherein in the second arrangement the second chamber is sealed and contains a fluid at a higher pressure than the first pressure. In the first arrangement the second chamber may be in fluid communication with the apparatus. In the first arrangement the second chamber may be in fluid communication with fluid in the well bore.

The method may comprise reconfiguring the second chamber from the second arrangement to a third arrangement in which the second chamber is in fluid communication with a first chamber. The first chamber may the chamber containing the compressible fluid at the first pressure. The first chamber may be initially sealed. The second chamber may be reconfigured to the third arrangement by movement of the movable member. With the second chamber in the third arrangement, the fluid in the two chambers will equalise at the first pressure. The second chamber may be configured to over-stress under external hydrostatic pressure when the second chamber is in the third configuration, wherein the body is in the second configuration and is at least partially severed. The external hydrostatic pressure may be higher than the first pressure.

The method may further comprise applying an additional force to the tubing string to sever the apparatus. The additional force may comprise, for example, pulling and/or torque.

Reconfiguring the body to the second configuration may comprise reducing the volume of the chamber as the movable member is moved. The at least partial severing of the body may be the result of the impact force generated by the movement of the movable member and the reduction in volume of the at least one chamber.

Reconfiguring the body to the second configuration may comprise piercing the body with a cutting implement. The cutting implement may be operatively associated with the movable member.

The method may comprise activating the apparatus to reconfigure the apparatus from the first configuration to the second configuration.

The method may further comprise sending a signal to the apparatus, wherein upon receipt of the signal a signal, the apparatus is reconfigured from the first configuration to the second configuration.

The method may comprise translating an activating device through the tubing to land on an activating profile. The method may comprise increasing the pressure above the activating member to expose the apparatus to the second pressure.

The method may comprise reconfiguring the second chamber from the first arrangement to the second arrangement using the activating device. The method may comprise landing the activating device in a position wherein the second chamber is reconfigured from the first arrangement to the second arrangement.

The method may comprise reconfiguring the apparatus from the first configuration to the second configuration using a selected activating device which is configured to co-operate with the apparatus.

The method may comprise landing the activating device on the activating profile, wherein the activating profile is located above the chamber. The method may comprise landing the activating device on the activating profile, wherein the activating profile is located above the chamber wherein the activating profile is located below the chamber.

The method may comprise passing the activating device through further activation mechanism. The further activation mechanism may be operatively associated with the movable member such that the further activation mechanism may be configured to prevent inadvertent movement of the movable member. The method may comprise passing the activating device through several further activation mechanisms, for example but not limited to two, or three activation mechanisms.

The method may comprise unlocking a locking device operatively associated with the movable member by translating the activating device through the mechanical lock prior the activating device landing on the activating profile.

Another aspect of the disclosure relates to a downhole apparatus comprising:

a tubular body for incorporation in a tubing string, the tubular body having a chamber with an initial sealed volume defined at least in part by a moveable member and configured to contain a compressible fluid at a first pressure, the moveable member being moveable on exposure of the apparatus to a second pressure higher than the first pressure and creating a pressure differential above a predetermined magnitude to reduce the volume of the chamber, wherein the apparatus comprises a cutting implement operatively associated with the moveable member such that as the volume of the chamber is reduced, a cutting force is applied to the body.

Another aspect of the disclosure relates to a downhole method comprising:

providing in a tubing string an apparatus comprising a body and movable member collectively defining a chamber having an initial volume at a first pressure, and a cutting implement operatively associated with the movable member;

exposing the apparatus to a second pressure, higher than the first pressure and creating a pressure differential above a predetermined magnitude to move the movable member and reduce the volume of the chamber, wherein, the cutting implement pierces the body with a cutting force generated as the chamber volume is reduced.

Another aspect relates to a downhole apparatus comprising:

a tubular body for incorporation in a tubing string, the tubular body comprising a sealed chamber containing a compressible fluid at a first pressure, wherein the body is configured to maintain the compressible fluid at the first pressure and build up potential energy as the apparatus is run downhole;

wherein the apparatus is configured to allow the release of the built-up potential energy at a downhole location to at least partially sever the body.

The apparatus may comprise a movable member, wherein the release of built-up potential energy may comprise reducing the volume of the chamber to convert the potential energy to kinetic energy, translating the movable member to at least partially sever the body and at least partially sever the body.

The apparatus may comprise a second chamber configured to contain a fluid at a second pressure higher than the first pressure, wherein the release of the built-up potential energy may comprise reducing the pressure of the fluid in the second chamber to the first pressure, and wherein a portion of the second chamber is configured to be overstressed by an external hydrostatic pressure which is higher than the first pressure to at least partially sever the body. Reducing the pressure of the fluid in the second chamber may comprise bring the first and second chambers into fluid communication.

The first pressure may be relatively low pressure compared to well bore pressure. The first pressure may be atmospheric pressure.

Another aspect relates to a downhole method comprising:

running an apparatus comprising a body having a chamber containing a compressible fluid at a first pressure, wherein the compressible fluid is maintained at the first pressure and the potential energy of the apparatus increases as the apparatus is run in hole; and releasing the built-up potential energy to at least partially sever the body at a downhole location.

Another aspect of the disclosure relates to use of a downhole apparatus to at least partially sever the apparatus, wherein the apparatus is configured to build up potential energy as the apparatus is run downhole and then subsequently releasing the built-up potential energy to at least partially sever the apparatus.

It will be understood that features defined above or below may be utilised in isolation or in combination with any other defined feature.

The various aspects described above may be provided individually or may be combined. Further, the various other features described above may be provided in combination with any of the aspects described above, or in combination with any of the features set out in the appended claims.

BRIEF DESCRIPTION OF THE DRAWINGS

These and other aspects of the disclosure will now be described, by way of example only, with reference to the accompanying drawings, in which.

DETAILED DESCRIPTION OF THE DRAWINGS

Reference is first made to FIGS. 1*a* to 1*d* of the drawings, which are schematic illustrations of an offshore well 10.

Figure 1A:
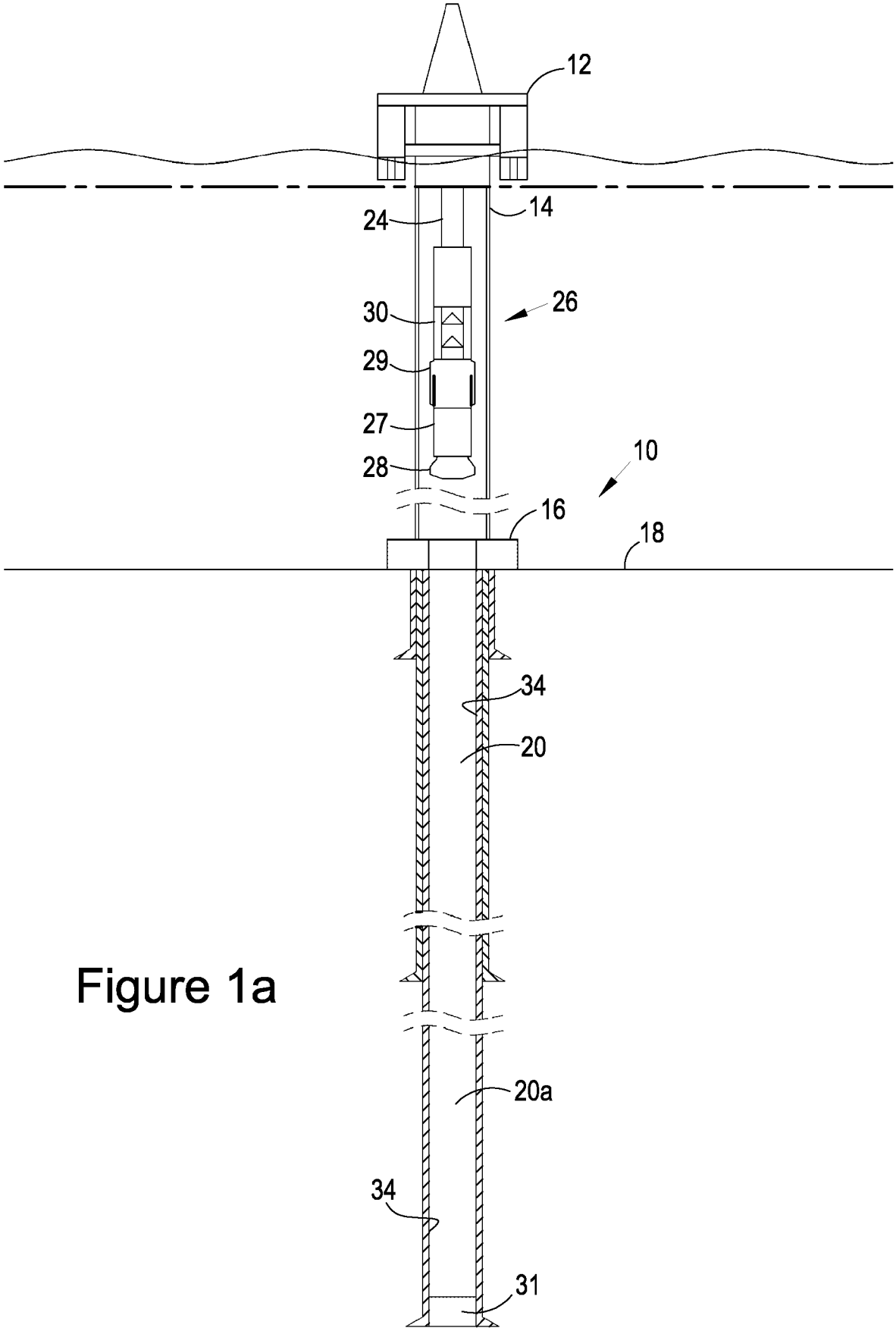
FIGS. 1*a* to 1*d* are schematics illustrations of an offshore well, showing steps in accordance with an example of the disclosure.
Figure 1B:
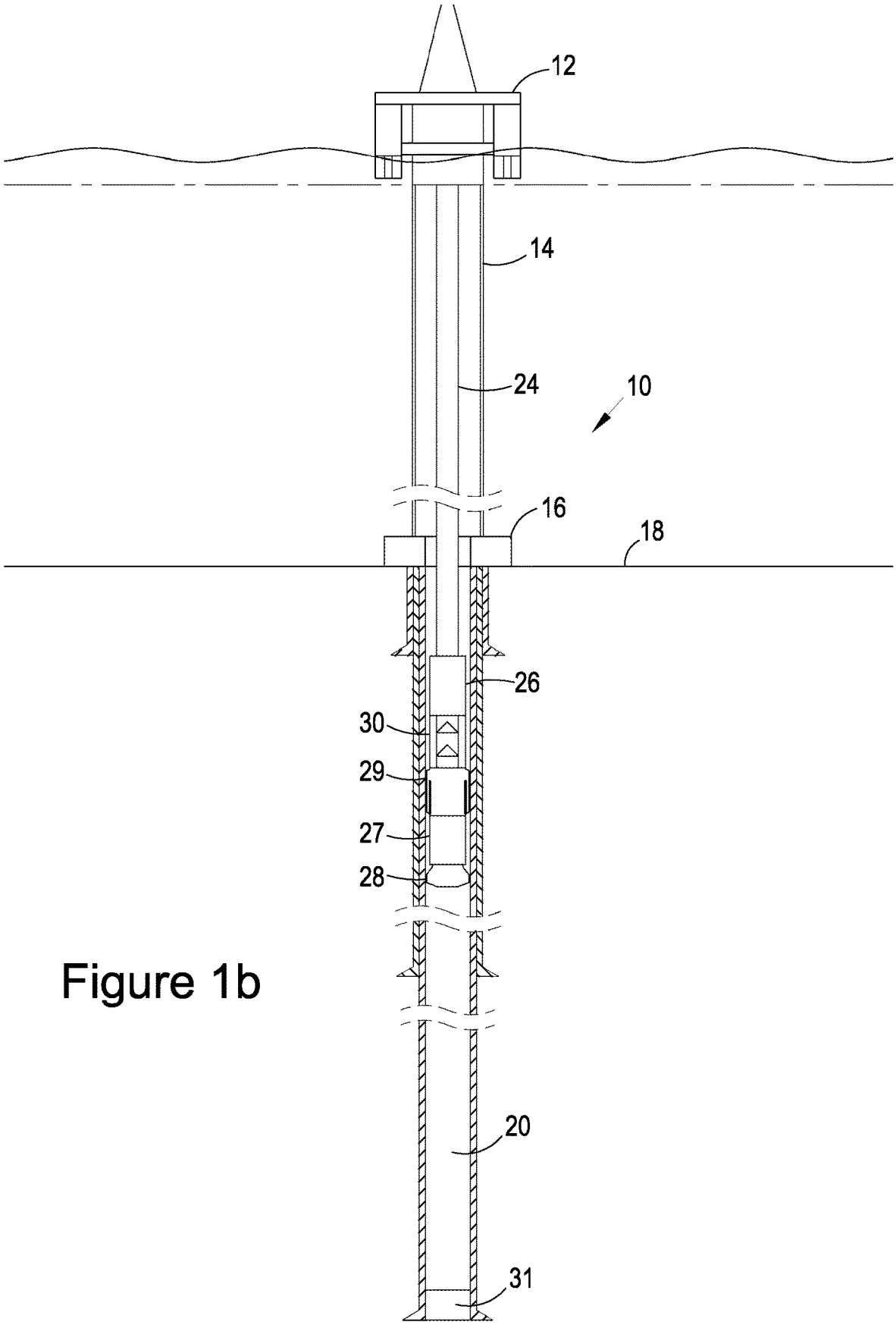
Figure 1C:
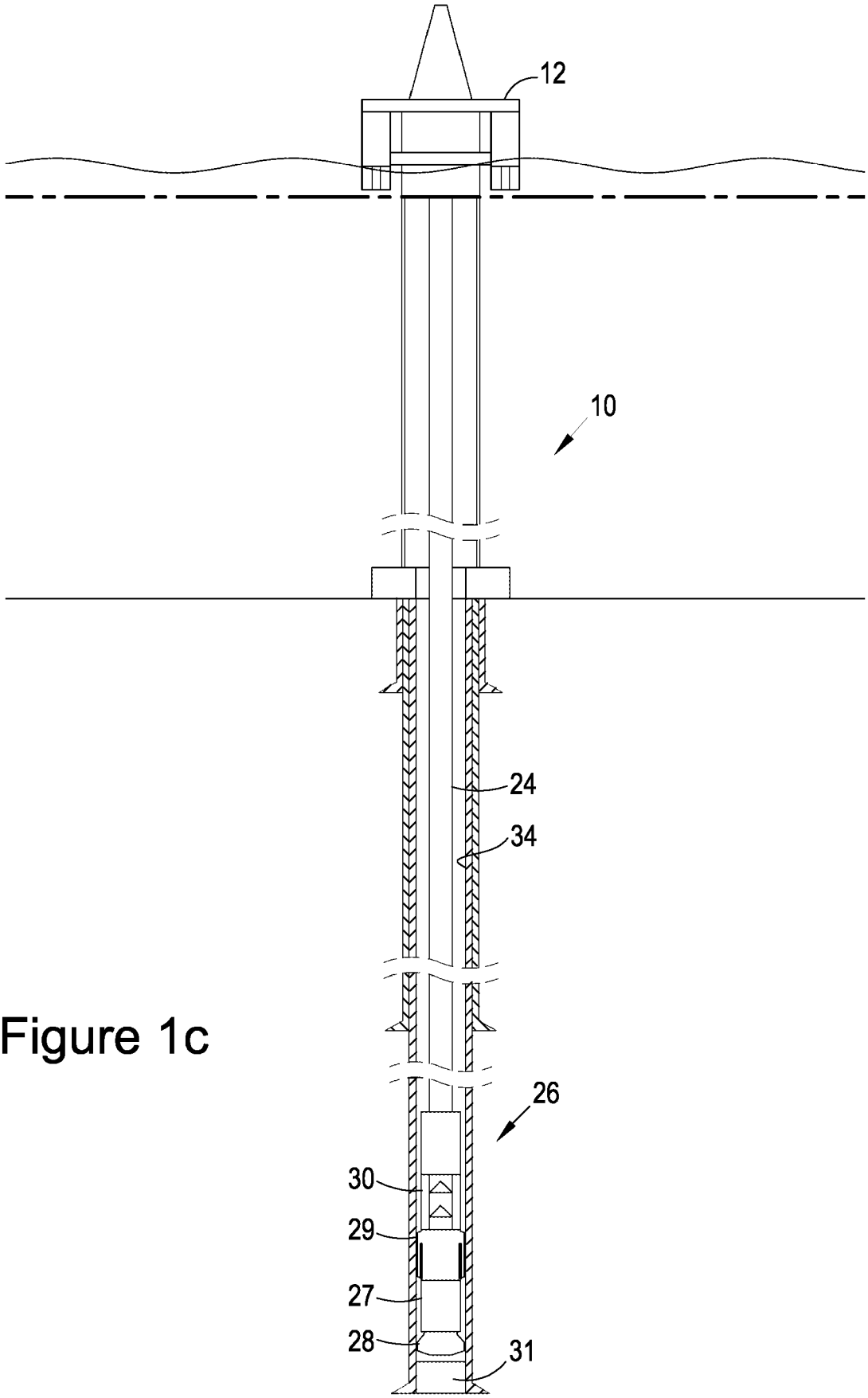
Figure 1D:
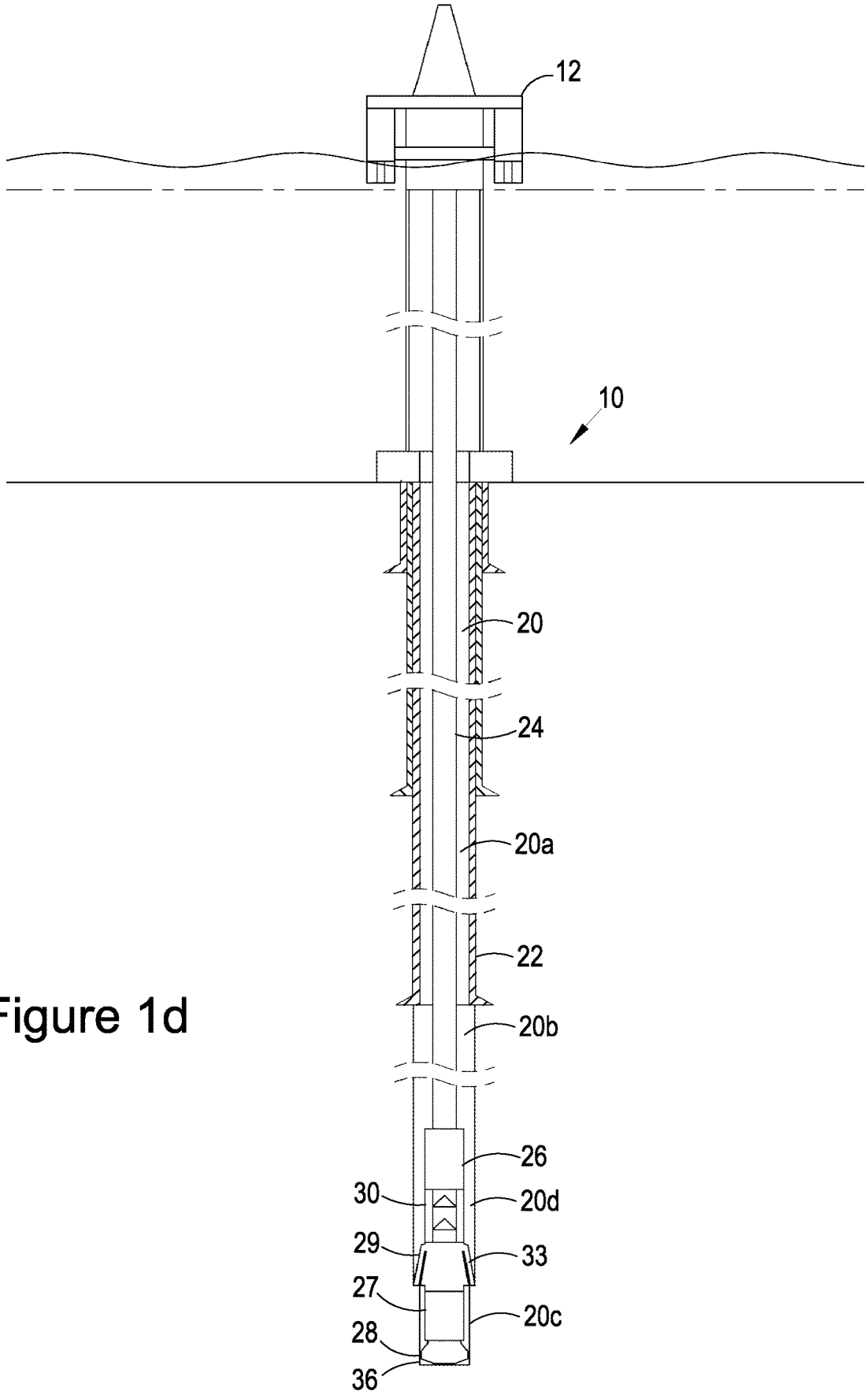

Drilling operations are run from the deck of a rig 12 and a riser 14 extends from the rig 12 to a blowout preventer (BOP) 16 on the sea floor 18. A well bore 20 extends through the riser 14 and into the earth below the BOP 16. An upper section of the drilled bore 20*a* is lined with casing 22. A newly drilled lower section of the bore 20*b*, as illustrated in FIG. 1*d*, is unlined. FIGS. 1*a*, 1*b* and 1*c* show a drill string 24 being tripped into the bore 20, and FIG. 1*d* shows the drilling of the bore 20 beyond the end of the last section of casing 22.

The drill string 24 is formed primarily of jointed drill pipe sections. The leading or distal end of the string 24 includes a bottom hole assembly (BHA) 26, and a drill bit 28 is mounted on the distal end of the string 24. The BHA 26 may comprise drill collars and tools and apparatus such as stabilisers, downhole motors, bent subs, measurement-while-drilling and logging-while-drilling (MWD and LWD) tools, bypass tools, under-reamers, jars, rotary steerable systems (RSS) and the like; a typical BHA 26 may be 500 to 700 feet long. In this example the BHA 26 features at least an MWD/LWD tool 27 and an under-reamer 29. This BHA 26 also includes a check or float valve 30 which, when operational, allows drilling fluid to be pumped down through the string 24 but which prevents fluid from flowing up through the string 24.

As will be described, the float valve 30 is Initially provided in an inoperative or held-open configuration, in which fluid may flow both downwards and upwards through the string 24 without activating the valve 30. This is useful as the string 24 may self-fill as the string 24 is made-up and run into the well, as described below.

The bore 20 is filled with fluid and the hydrostatic fluid pressure within the bore 20 is significant. The string 24 is made up from tubular drill pipe sections and if fluid was not permitted to flow into the string 24 (typically through jetting nozzles in the drill bit 28) the hydrostatic pressure in the bore 20 would ultimately damage or collapse the string 24. Accordingly, the string 24 may be top-filled with fluid or, when provided with a float valve 30 as described herein, may "self-fill". However, before drilling commences the float valve 30 is reconfigured to an operative or closed configuration, preventing further upward flow through the string 24, but permitting drilling fluid to be pumped down through the string 24 to exit through the drill bit jetting nozzles and return to surface via the annulus 32 between the string 24 and the bore wall 34.

While the drill string 24 is being run or tripped in it is generally considered desirable to test some of the apparatus in the BHA 26, such as the MWD/LWD tool 27, by pumping fluid down through the string 24, and through the open the float valve 30. This may take place, for example, when the BHA 26 is at a depth of 1500-2000 feet below the rig floor, as illustrated in FIG. 1*a*. In deep water operations this test may be carried out, as illustrated in FIG. 1*a*, while the BHA 26 is located within the riser 14. This operation is known as a shallow-hole test and allows the operator to identify any problems with the BHA 26 at an early stage, for example to ensure that the MWD/LWD tool 27 is capable of generating and transmitting pressure pulses. The operator may thus identify if it is necessary to retrieve the BHA 26 to surface before making up more of the drill string 24.

Figure 10:
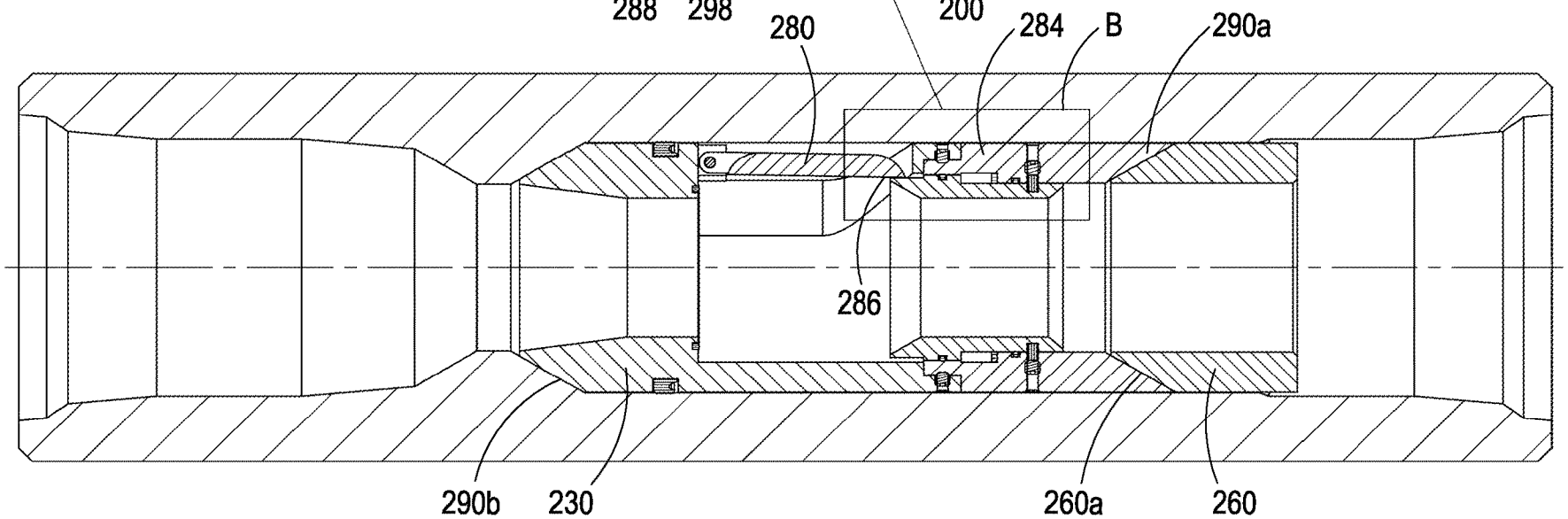
FIG. 10 is an alternative float valve according to an embodiment of the disclosure.

If the shallow-hole test does not identify any problems that require the BHA 26 to be retrieved to surface, the operator continues to make up the drill string 24 such that the BHA 26 is tripped further into the bore 20. As will be described in detail below with reference to the other figures, the float valve 30 includes a hydraulic switch which releases a flow restriction of a float valve retainer when the float valve 30 reaches a predetermined depth in the bore 20 and is exposed to a corresponding hydrostatic pressure, as illustrated in FIG. 1*b*. Once the flow restriction has been released to an extended configuration, a pressure differential may be created across the flow restriction: when it is considered necessary or appropriate, the operator simply activates the rig pumps to initiate downwards flow through the string 24, to release the retainer and allow the float valve to close. However, the operator will likely choose not to close the valve 30 at this point in the bore 20: the released flow restriction does not respond to upwards flow, as will be created by fluid flowing into the string 24 through the jetting nozzles in the drill bit 28. Thus, the operator may continue to make up the drill string 24 and trip the BHA 26 deeper into the bore 20, while the string 24 is allowed to continue to self-fill through the open float valve 30, When the BHA 26 reaches a depth where the operator considers it appropriate to close the float valve 30, for example 1000 feet or less from the end of the existing bore 20, as illustrated in FIG. 10, the operator activates the drilling fluid pumps on the rig 12 to flow fluid down through the string 24. The flow through the string 24 creates a pressure differential across the flow restriction and reconfigures the float valve retainer. The float valve 30 may then move to the closed or operative configuration.

With the float valve 30 in the closed configuration a float valve member is normally closed, that is biased to a closed position, and prevents fluid from flowing up through the string 24. However, normal fluid circulation, that is fluid flowing down through the drill string 24 towards the drill bit 28, pushes the valve member open. Also, in the example described herein, a device or tool dropped or pumped down through the valve 30 may also push the valve member open, and pass through the valve 30. Thus, depending on the location of the valve 30 in the string 24, the operator may use balls or darts to actuate tools or devices in the BHA 26 below the closed valve 30; for example, a ball may be dropped from surface and pass through the string 24 and the closed valve 30 to activate the under-reamer 29.

As the operation of the float valve 30 is independent of the deployment of activation devices there is additional flexibility in the location and operation of the valve 30. For example, the valve 30 may be located below tools or devices which would obstruct the passage of an activation device into the valve 30.

In the example described herein the reconfiguring of the float valve retainer may be identified by the operator. Furthermore, the string 24 will no longer self-fill as the string is tripped in to the end of the bore 20 once the valve 30 has closed. If the string 24 continues to self-fill the valve 30 has not closed and further action will be required, The operator may then continue to trip the string 24 into the bore 20 until the drill bit 28 is at the distal end of the bore 20, where drilling may commence. FIGS. 1*a* to 1*d* illustrate a bore 20 in which the most recently-run section of casing 22 has been cemented, leaving a cement shoe track 31 at the distal end of the bore. The cement shoe track 31 may comprise a cylinder of set cement which is 80 to 160 feet long and which must be removed by the drill bit 28. The drill string 24 is rotated which in turn rotates the drill bit 28, or the BHA may include a downhole motor. Simultaneously, drilling fluid is pumped from the rig 12, down through the string 24, through the float valve 30, and out of the jetting nozzles in the bit 28. The drilling fluid cools the bit 28 and carries drill cuttings away from the cutting face 36. In addition, the density or weight of the drilling fluid is carefully controlled and monitored to assist the operator in providing well control and in controlling and protecting the rock formation that will be exposed by the drilling operation. The weight of the drilling fluid may be varied and controlled by the operator throughout the operation, for example depending on whether the bore 20 is wholly lined or includes an unlined section, and the weight of the drilling fluid may be changed by the operator before drilling commences.

Initially, only the drill bit 28 is utilised to drill through the cement shoe track 31 and advance the bore beyond the end of the casing 22, until the under-reamer 29 is located beyond the end of the casing 22. At that point a ball may be dropped through the string 24, and through the closed valve 30, to land in and activate the under-reamer 29, such that the under-reamer cutters 33 may be extended. Thus, as illustrated in FIG. 1*d,* beyond the end of the casing 22 the drill bit 28 cuts a pilot bore 20*c* which is radially enlarged by the under-reamer 29 to provide a bore 20*d* having a diameter larger than the internal diameter of the casing 22.

This sequence of operations would not be possible with a float valve which relied on activation by dropping or pumping a ball or dart into the valve, as the presence of the ball or dart in the valve would prevent the subsequent activation of the under-reamer 29. Thus, it would have been necessary to drill with the float valve open until the under-reamer was activated and only then drop or pump an activating device into the valve. This would involve drilling in open hole without an operating float valve.

If at any point there is a tendency for fluid to flow up the inside of the drill string 24, this is prevented by the float valve 30; in the embodiment described below the activated float valve 30 is normally-closed, and there is no opportunity for fluid to flow up the inside of the string 24.

The float valve 30 and its operation will now be described in detail with reference to FIGS. 2 through 7 of the drawings. In accordance with convention the Figures show the valve 30 in a horizontal orientation, with the left hand side of the Figures representing the upper end of the valve 30 and the right hand side of the Figures representing the lower end of the valve.

Figure 2:
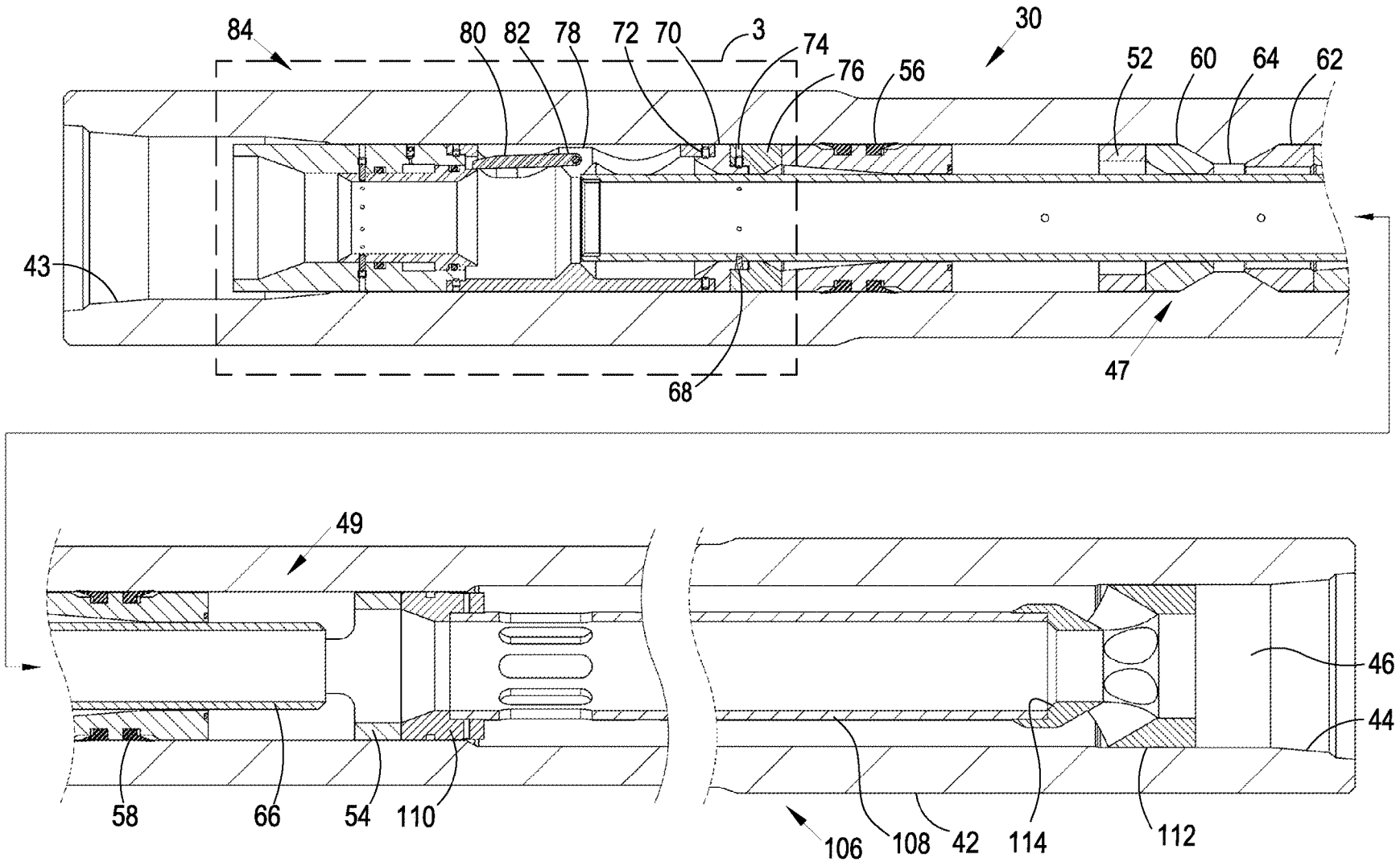
FIG. 2 is a sectional view of a float valve of an embodiment of the disclosure, the float valve being illustrated in an open configuration.
Figure 3:
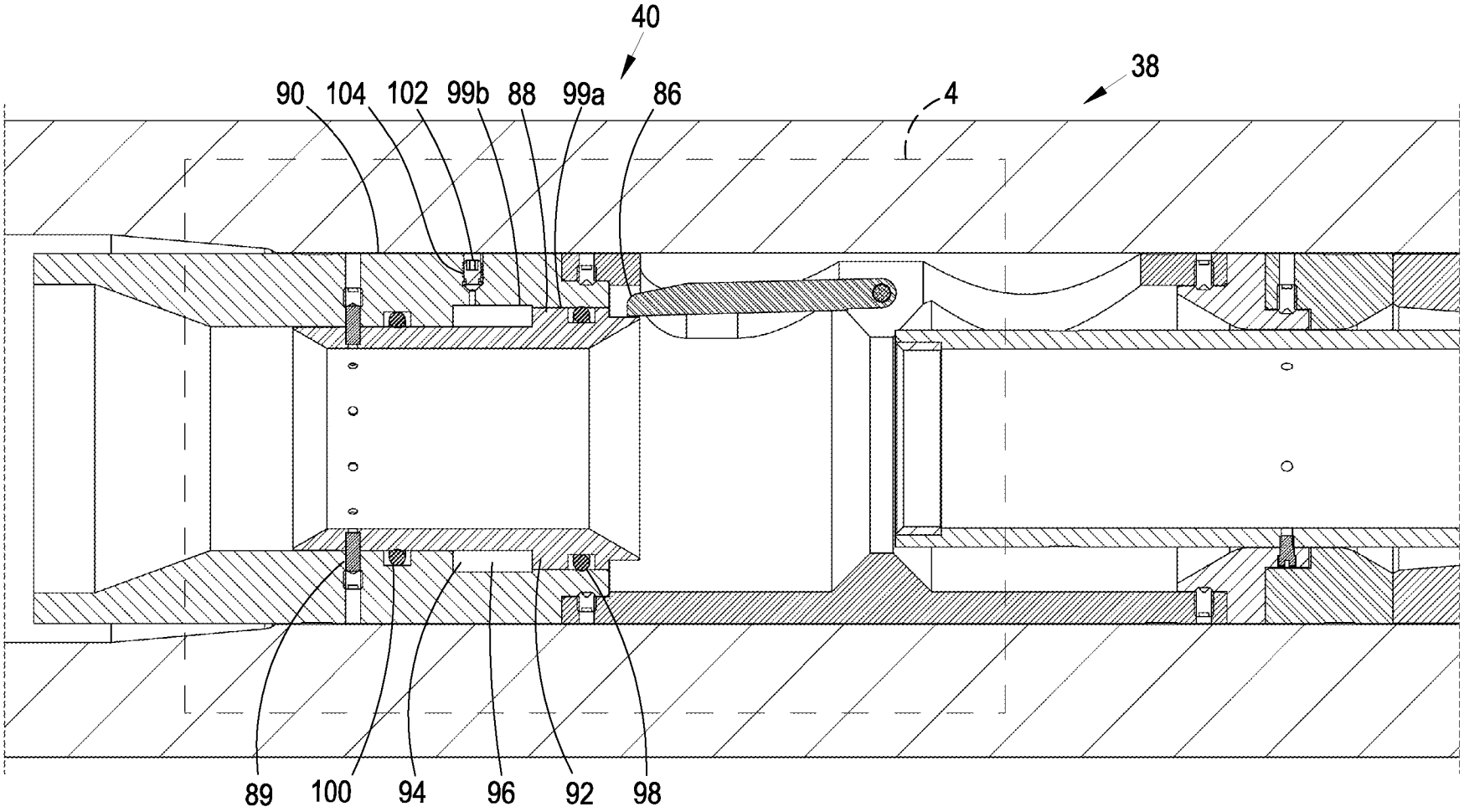
FIG. 3 is an enlarged sectional view of area 3 of FIG. 2, illustrating a float valve retainer with a flow restriction in a retracted configuration.
Figure 4:
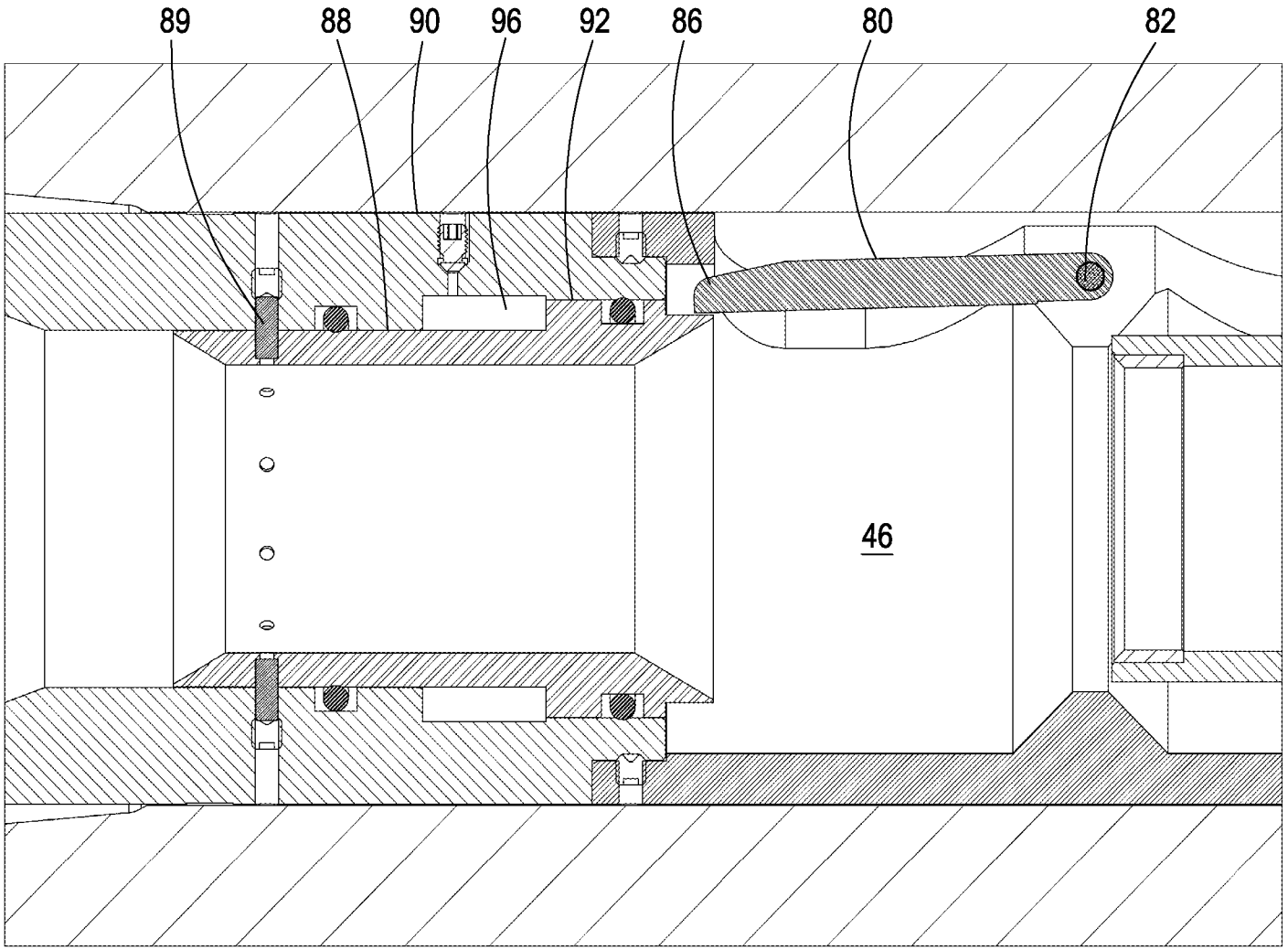
FIG. 4 is an enlarged view of area 4 of FIG. 3.

Reference is first made to FIG. 2 of the drawings, a sectional view of a float valve 30 of an embodiment of the disclosure, the float valve 30 being illustrated in an initial inoperative or held-open configuration. Reference is also made to FIG. 3 of the drawings, an enlarged sectional view of area 3 of FIG. 2, illustrating a float valve retainer 38 forming part of a float valve actuator 40 in a first inactive or retracted configuration. FIG. 4 of the drawings is an enlarged view of area 4 of FIG. 3.

Figure 6:
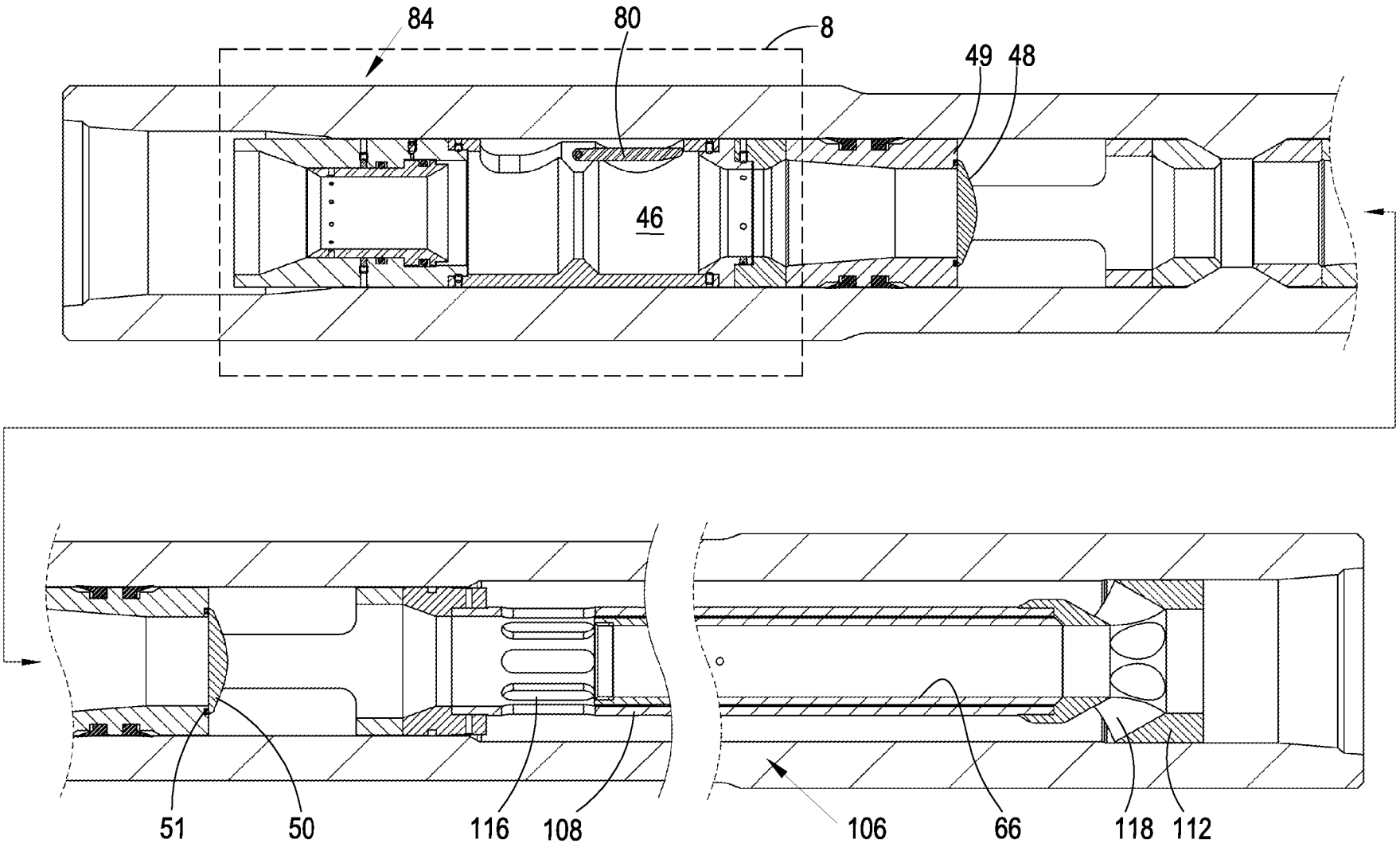
FIG. 6 illustrates the float valve of FIG. 1 with the float valve illustrated in a closed configuration.

The float valve 30 comprises an elongate tubular body 42 adapted for incorporation in a drill string 24, typically in or adjacent the BHA 26, and in the embodiment described herein within the BHA 26 and above the MWD/LWD tool 27 and the under-reamer 29. In other examples the valve could be provided at the distal end of the BHA 26, directly adjacent the drill bit 28, or in the drill string 24 above the BHA 26. The body 42 includes female or box end connections 43, 44 for coupling with adjacent drill string elements. A generally cylindrical bore 46 extends through the body 42 and accommodates the primary operating elements of the valve 30. The illustrated valve 30 includes two float cartridges 47, 49, each comprising a respective float valve member or float flapper 48, 50 (FIG. 6). The float cartridges 47, 49 are provided in a central portion of the bore 46. The pivoting flapper valve members 48, 50 are mounted in respective partially cut-away sleeves 52, 54, each sleeve 52, 54 carrying external seals 56, 58 to provide sealing engagement with the inner wall of the bore 46. When assembling the valve 30, the float cartridges 47, 49 are inserted into the opposite ends of the body 42 and engage respective spacers 60, 62 on either end of a bore restriction 64.

In the initial valve configuration of FIGS. 2, 3 and 4 the float flappers 48, 50 are held open by a retainer member in the form of a tube 66. The tube 66 is initially fixed in position by shear pins 68 which extend through a collar 70, the collar 70 being fixed by grub screws 72, 74 to a spacer 76 which abuts the upper end of the sleeve 52 and a sleeve 78 which provides a mounting for a flow restriction in the form of tube-releasing pivoting flapper 80. The upper end of the tube 66 extends part-way through the sleeve 78 and initially lies in a plane directly below the flapper pivot pin 82.

The tube-releasing flapper 80 is initially inoperative and is retained in an open or retracted position by a retainer in the form of a hydraulic switch 84. In particular, a flapper edge portion 86 is restrained by an end of a movable sleeve 88, mounted within a tubular switch body 90. The sleeve 88 is illustrated fixed in position relative to the body 90 by shear pins 89. The sleeve 88 has an external shoulder 92 which may travel within a body recess 94; in the initial configuration as illustrated in FIGS. 2, 3 and 4, axially and laterally extending surfaces of the sleeve 88 and body 90 collectively define an annular chamber 96. The chamber 96 is isolated from the valve body bore by a seal 98 mounted in a slot in the shoulder 92 which engages a wall of the recess 94 and a seal 100 mounted in a slot in the inner wall of the body 90 which engages an outer wall of the sleeve 88. It will be noted that the wall of the recess 94 is stepped, with the seal 98 initially engaging a smaller diameter wall portion 99*a*. If the sleeve 88 moves upwards relative to the body 90 and the seal 98 is located within the larger diameter wall portion 99*b,* sealing contact is lost; this is intended to prevent pressurised fluid from becoming trapped in the chamber 96 which might otherwise result in pressure locking of the sleeve 88 and body 90, and limits the risk of galling between of the contacting surfaces if the sleeve 88 is moved very quickly relative to the body 90.

To facilitate assembly, a plug 102 located in a bleed hole 104 in the body 90 may be removed to permit fluid to flow into and out of the chamber 96; alter the sleeve 88 and body 90 are assembled and fixed relative to one another by the shear pins 89 the plug 102 is fixed and sealed in the bleed hole 104. In this example the plug 102 comprises a copper wedge with provides the sealing function and a non-sealing grub screw which holds the wedge in the hole 104. In the illustrated embodiment the chamber 96 will initially contain air at atmospheric pressure, though if desired the chamber 96 may be part filled with a liquid such as hydraulic oil.

The lower end of the float valve body 42 accommodates a catcher assembly 106 for receiving and retaining the released retainer tube 66. The catcher assembly 106 itself comprises a tube 108 dimensioned to receive the tube 66, the catcher tube 108 being centrally mounted in the body bore by end collars 110, 112. The lower collar 112 includes a locating face 114 for engaging the end of the released tube 66.

The float valve 30 is assembled and incorporated in the string 26 as described above and run into the fluid-filled bore 20. The open float valve 30 permits fluid to flow from the bore 20 into and up through the string 24 as the string is made up and lowered into the bore 20. At a certain depth, for example 1500 feet below the rig floor, as illustrated in FIG. 1*a,* the operator pumps drilling fluid down through the string 24 to test the tools and devices in the BHA 26 which are flow-operated, or which otherwise rely an flow to function. For example, the test may be used to ensure that the MWD/LWD tool 29 generates and transmits appropriate pressure pulse signals. Assuming that the test is completed without any problems being identified, the operator then continues to make up the string 24.

As the valve 30 is lowered deeper into the bore 20 the hydrostatic pressure experienced by the valve 30 increases. As the sealed chamber 96 defined between the sleeve 88 and the body 90 contains air at atmospheric pressure, the higher pressure in the bore 20 generates a pressure force across the shoulder 92, which force is resisted by the shear pins 89. Accordingly, by selection of an appropriate number and rating of shear pins 89, the operator may select when the hydrostatic pressure force is sufficient to shear the pins 89 and translate the sleeve 88 upwards. The lower end of the sleeve 88 thus disengages from the edge of the flapper 86, and the flapper 80 is free to rotate. The sleeve 88 has thus served as a detent for the flapper 80.

It will be noted that the release of the flapper 80 is achieved without the requirement to drop or pump an activating device such as a ball or dart into the string 24. Thus, there is no need to break the string 24 at surface to insert an activating device, or wait while the activating device travels down through the string 24. This activation method also allows the valve 30 to be positioned in the BHA below tools or devices which would prevent the passage of a ball or dart, or for the valve 30 to be positioned above tools which require subsequent activation by ball or dart, such as the boll-activated under-reamer 29.

In this example the shear pins 89 may be selected to release the sleeve 88 when the fluid pressure in the bore 20 reaches a level of, for example, 5000 psi. This pressure may result solely from hydrostatic pressure or from a combination of hydrostatic pressure and pump pressure. Thus, for the shallow hole-test as illustrated in FIG. 1*a*, the hydrostatic pressure may be 1500 psi and the operation of the rig pumps may add an additional 1500 psi, to provide an absolute pressure of 3000 psi. Thus, the shear pins 89, rated at 5000 psi, retain the sleeve 88 in position and the valve 30 remains in the open or inoperative configuration as the MWD/LWD tool 27 is tested. Only when the valve 30 reaches a depth in the bore 20 where the hydrostatic pressure is 5000 psi, as illustrated in FIG. 1*b*, do the pins 89 shear.

Figure 5:
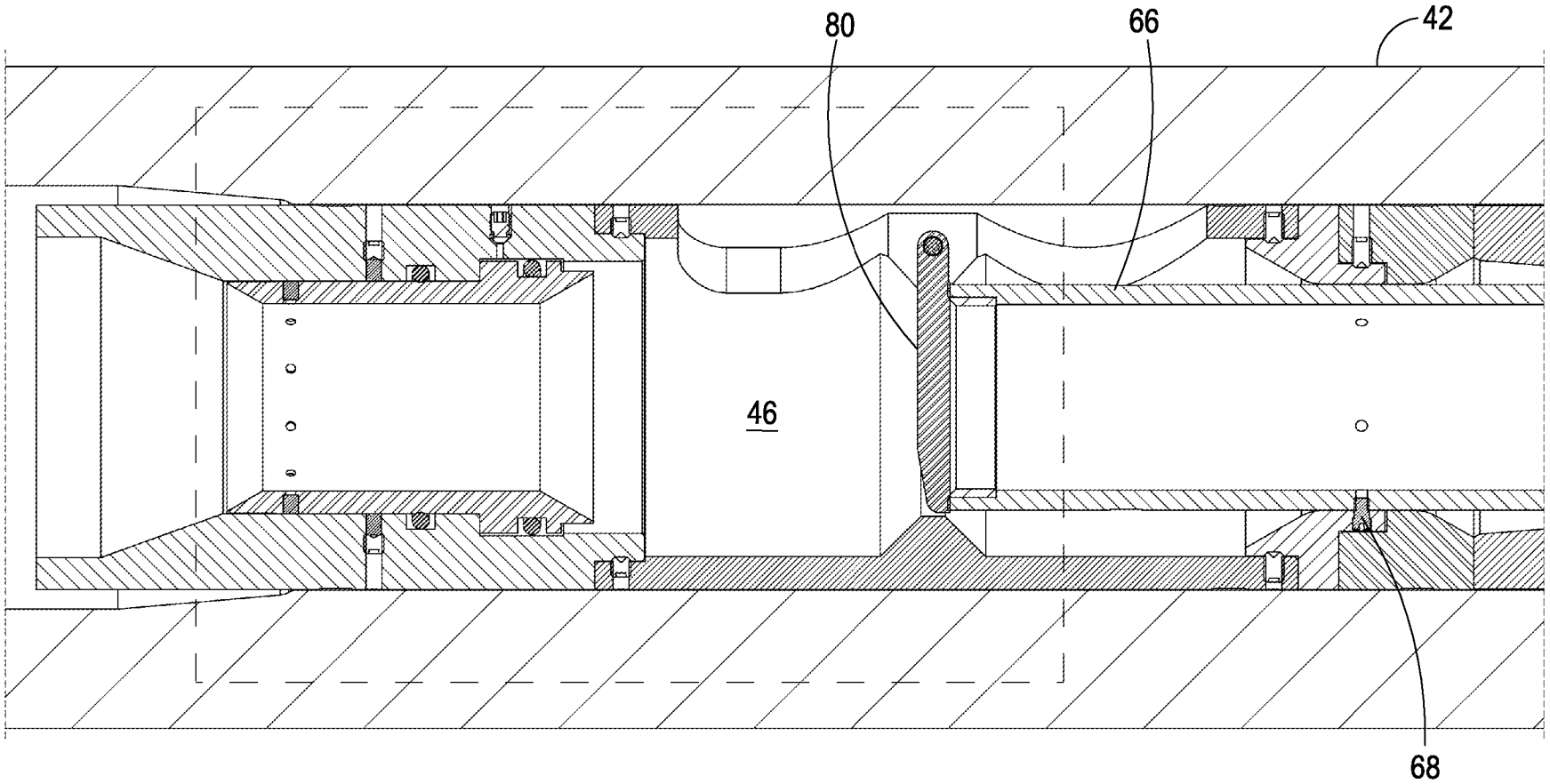
FIG. 5 is a sectional view corresponding to FIG. 3, but illustrating the float valve retainer with the flow restriction in an extended configuration.

The flapper mounting pin 82 is sprung (spring not shown) and arranged to urge the flapper 80 to rotate from an initial position in which the flapper 80 extends upwards and parallel to the main valve/string axis, to a position in which the flapper 80 extends into the valve bore 46. Thus, on release, the flapper 80 is rotated through perhaps 45 degrees into the valve bore 46 by the mounting pin spring and will be further rotated under the influence of gravity until the flapper 80 lands on the upper end of the retainer tube 66, as illustrated in FIG. 5 of the drawings. With the flapper 80 in this configuration the string 24 may continue to self-fill. In particular, as the string 24 is further made up and run into the bore 20, fluid may flow into the string 24 from the bore 20 and lift the flapper 80 off the end of the tube 66.

Figure 7:
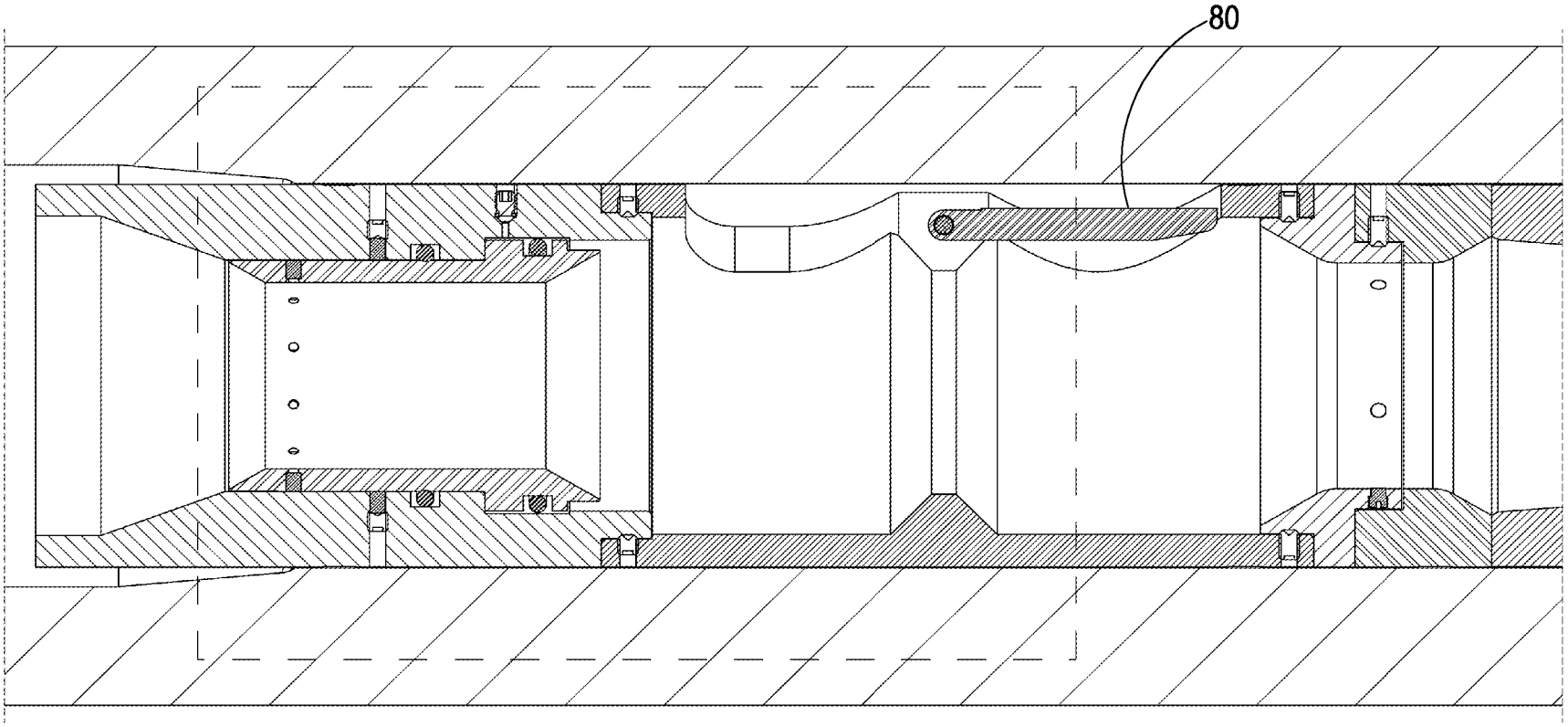
FIG. 7 is an enlarged sectional view of area 7 of FIG. 6.

Once the string 24 has been run in sufficiently to locate the drill bit 28 at or close to the end of the bore 20, as illustrated in FIG. 1*c*, the operator may activate the float valve 30 by pumping fluid down through the string 24. In particular, flow of fluid through the valve 30 pushes the released flapper 80 downwards against the upper end of the retainer tube 66. In this position, the flapper 80 creates a flow restriction in the tool bore and closes-off the upper end of the tube 66. This creates a pressure differential across the extended flapper 80, resulting in an axial force being applied by the flapper 80 to the tube 66. This force may be significant and is sufficient to shear the pins 68 retaining the tube 66. The flapper pivot pin 82 is provided "loose" to ensure that the flapper 80 will sit square on the end of the tube 66. Once the tube-retaining pins 68 have sheared, flow will continue to push the flapper 80 and tube 66 downwards and the tube 66 will be pushed through the body 42 and into the catcher assembly 106. The release of the tube 66 is evident to the operator on surface as a sudden drop in pressure With the tube 66 pushed from the upper part of the body 42, the flapper 80 is now free to rotate further to the second retracted position, parallel to the body axis and to the side of the body bore 46, as illustrated in FIGS. 6 and 7 of the drawings.

The float flappers 48, 50 are now free to rotate and close the body bore 46, as illustrated in FIG. 6. It is still possible to pump fluid down through the string 24 as the flow simply pushes the flappers 48, 50 open. However, flow of fluid up the string 24 is prevented, as any upward flow will simply urge the normally-closed float flappers 48, 50 into tighter contact with the associated seats 49, 51. Thus, the string 24 is protected against inflow from the well bore 20.

As evident from the above description, the float flappers 48, 50 may remain held open and inoperative until the operator chooses to activate the valve 30. As noted above, the hydraulic switch 84 operates to free the flapper 80 at a preselected hydrostatic pressure and at any appropriate point after this the operator may activate the rig pumps to create a pressure differential across the flapper 80 and push the tube 66 past the float flappers 48, 50.

Of course an operator may choose to release the flapper 80 and immediately activate the valve 30. This could be achieved, for example, by waiting until the valve 30 had been tripped into a depth in the bore 20 where the hydrostatic pressure was 4000 psi, if the rig pumps were then activated to provide an additional 1500 psi of pressure the absolute fluid pressure within the string 24 at the valve 30 would be 5500 psi. This would shear the 5000 psi rated pins 89 and cause the sleeve 88 to move upwards as the volume of the chamber 96 rapidly decreased. The flapper 80 would then be pushed into the valve bore 36 and the fluid being pumped through the valve 30 would immediately move the flapper 80 to engage the upper end of the tube 66, and then push the tube 66 past the float flappers 48, 50.

An operator may also choose to activate the valve 30 only when drilling commences, and thus have the string 24 capable of self-filling over the duration of the tripping operation. This would be achieved by selecting shear pins 89 with a rating that is higher than the hydrostatic pressure experienced during tripping in. For example, the pins 89 may have a rating that is 1000 psi higher than the hydrostatic pressure at the distal end of the bore 20.

Thus, the pins 89 will only shear when the operator activates the rig pumps just prior to commencing drilling. The flapper 80 will then be released and immediately displace the tube 66, such that the valve 30 is operative.

As noted above, there is no requirement to drop or pump an activating ball or dart to activate the valve 30 and thus the valve bore may remain clear of obstructions. Thus, ball or dart-activated tools and devices, such as under-reamers, may be positioned below the valve 30 and activated after the valve. The ability to activate the valve 30 without the requirement to drop or pump an activating device into the valve 30 also provides for additional flexibility in the location of the valve 30 in a string; the valve 30 may be located below tools or devices that prevent passage of activating balls or darts.

Figure 8:
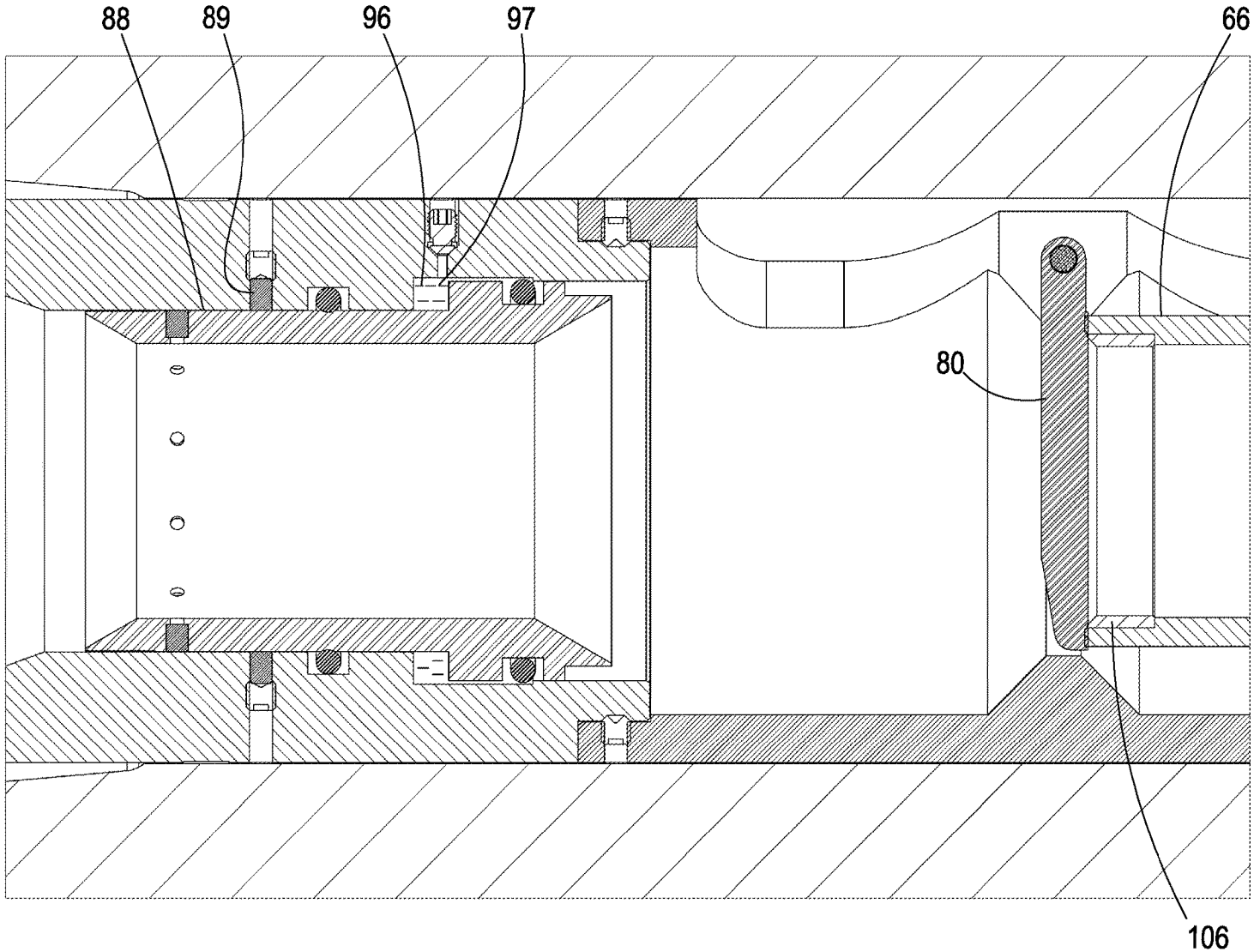
FIG. 8 is a sectional view of a portion of a float valve in accordance with an alternative embodiment of the disclosure.

If for any reason the hydraulic switch 84 does not release the flapper 80, or it is desired to release the flapper 80 before the release pressure can be attained, the upper end of the tube 66 is provided with a seat 106 to allow a ball, dart or the like to be pumped down the string 24 and close off the upper end of the tube 66. A pressure differential may thus be developed across dropped ball to shear the pins 68 and move the tube 66 downwards, allowing the float flappers 48, 50 to close, in a manner similar to the valves described in WO 20131079926 and WO 2014/140553. Even though the upper end of the tube 66 is closed, bypass passages 116, 118 in the catcher tube 108 and in the lower end collar 112 will allow fluid to flow down through the float valve bore 46. Reference is now made to FIG. 8, a sectional view of a portion of a float valve in accordance with an alternative embodiment of the disclosure. The valve 30 is identical to the valve 30 described above, however the chamber 96 contains a volume of liquid, in the form of oil 97, in addition to air at atmospheric pressure. Thus, when the valve 30 is exposed to a pressure of 5000 psi or above, the pins 89 will shear and the air in the chamber 96 will be compressed very rapidly as the sleeve 88 moves to reduce the volume of the chamber 96. However, the oil 97 is substantially incompressible and movement of the sleeve 88 is thus halted before the opposing sleeve and body surfaces meet. In the absence of the oil 97 the sleeve 88 may be travelling at a very high velocity when the surfaces meet and there may be a significant shock loading on the parts with an associated risk of damage. The sleeve 88 may still be travelling at a high velocity when the oil 97 and air in the chamber 96 are fully compressed; however any shock loading is transmitted via the oil 97 and is spread over a significantly greater area.

Figure 9:
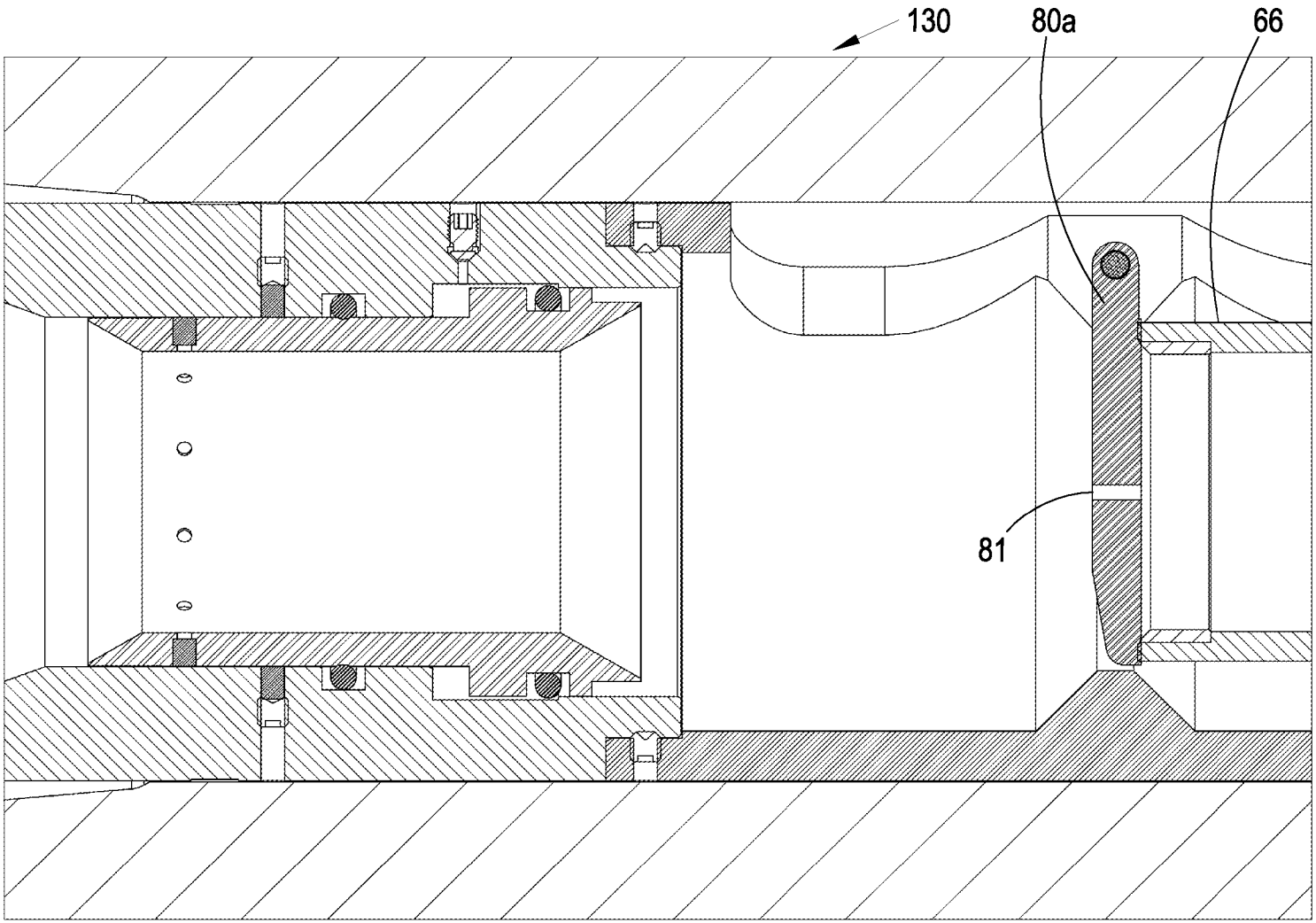
FIG. 9 is a sectional view of portion of a float valve in accordance with a further alternative embodiment of the disclosure.

Reference is now made to FIG. 9, a sectional view of a portion of a float valve 130 in accordance with an alternative embodiment of the disclosure. In this embodiment the tube-releasing flapper 80*a* is provided with a small through bore 81 which prevents the flapper 80*a* from plugging the string bore in the event that the tube 66 is not displaced.

It will be apparent to the skilled person that the above-described examples are merely exemplary of the disclosure and that various modifications and improvements may be made thereto. For example, poppet floats could be utilised rather than flapper or disc valves in conjunction with an alternative arrangement to maintain the floats open. Also, the above description is primarily directed to the provision of float or check valves for use in drilling operations. However, similar float valves may also be usefully employed in other tubing strings, such as casing or liner floats, and the present disclosure is equally applicable to such floats.

Multiple float valves may be provided in string, and different locations in the string.

Figure 11:
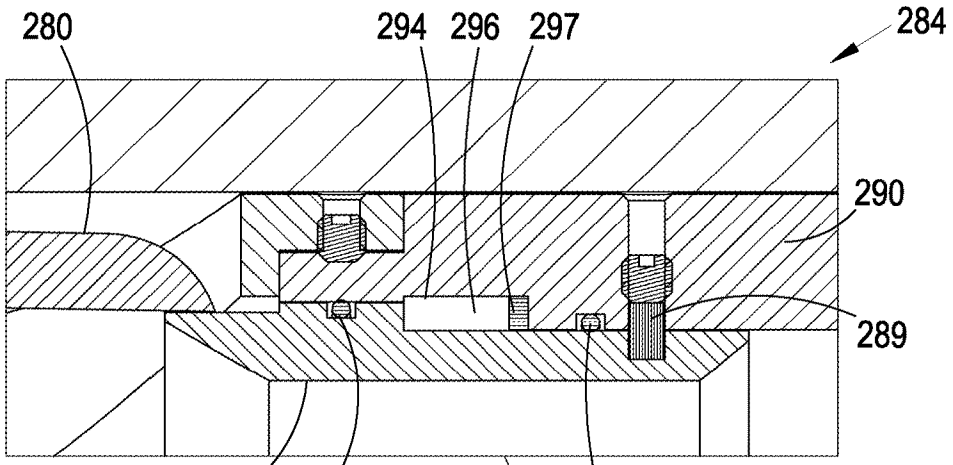
FIG. 11 is an enlarged section view of area B of FIG. 10, illustrating the hydraulic switch.

An alternative float valve 230 according to another embodiment is shown in FIGS. 10 and 11. Housing body 210 has an upper box 220 and lower box 240. The lower box 240 could include the pin of a drill bit such that the float valve 230 is located below all the MWD equipment. Alternatively, the housing body 210 may comprise a pin-pin sub on the bottom such that the valve 230 comprises a box at the top and a pin at the bottom.

The valve 230 comprises a hydraulic switch 284 which operates in a similar manner to the hydraulic switch 84 in valves 30, 130 described above. In this embodiment, the hydraulic switch 284 is located below a non-return flapper 280 and a tapered sleeve 288 holds the flapper 280 open. Therefore, the hydraulic switch 284 operates directly on the flapper 280 of the float valve 230. The sleeve 288 therefore acts as a float valve retainer in this configuration.

The hydraulic switch 284 comprises valve body 290 having a body recess 294. Sleeve 288 has an external shoulder 292 which can travel within the body recess 294. In an initial positon, as shown in FIG. 11, annular chamber 296 is defined between the laterally and axially extending surfaces of the sleeve 288 and body 290 with the sleeve 288 fixed in an initial position by shear pins 289. The sleeve 288 will translate within the body recess 294 closing the chamber 296 when the shear pins 289 are sheared. Annular chamber 296 is slightly more compact that the previous embodiment and further comprises a damping member in the form of a sacrificial gasket 297. Gasket 297 may be formed from a hard rubber, plastic or a soft metal and will absorb the impact energy generated as the chamber 296 is closed. The use of a gasket can be more convenient than using liquid or oil and may be utilised with the switch 84 previously described.

A bleed hole (not shown) associated the chamber 296 is provided to allow for assembly of the float valve 230. Seals 200 and 298 are similarly arranged to seals 98, 100 of hydraulic switch 84. In use, valve 230 will activate when the absolute pressure reaches the predetermined set pressure. This pressure can be set by selection of an appropriate number and rating of shear pins 289 such that when the absolute pressure reaches the set value, the shear pin will shear, allowing the sleeve 288 to move downwards and release the flapper 280. For example, in use in a horizontal well, the pressure could be selected to be slightly more than the hydrostatic pressure meaning that in order for the pins 289 to shear, an increased absolute pressure is required. This can be achieved by, for example, pumping at surface and can allow the float valve 230 to be activated, for example prior to commencing drilling operations.

The valve body 290 and a spacer 260 are incorporated into housing body 210 and comprise tapered ends 290*a*, 290*b* and 260*a*, respectively. This arrangement ensures that it is virtually impossible to place the valve incorrectly. Placement of the valve in the wrong way would have extreme consequences.

Unlike float valves 30, 130, the float valve 230 does not provide an indication at surface when the valve 230 is activated. However, float valve 230 is simpler and therefore, more cost effective. Furthermore, there is no inner pipe allowing the float bore 266 can be larger. Since valve 230 is activated using absolute pressure, the valve will work equally well at any downhole angle. In addition, having the hydraulic switch is directly connected to the flapper can improve reliability of the float valve 230. This does however, mean that unlike float valves 30, 130, the float valve 230 will activate immediately upon exposure to the pre-set pressure in comparison to valves 30, 130 which require exposure to a pre-determined hydrostatic pressure and a pressure differential to be generated across the flapper to push retainer tube 66 past the flapper floats.

It is envisaged that additional float valves may be included in the housing 210 by, for example, providing an extended housing. Each of the float valves will have their own hydraulic switch thus building redundancy into the tool. It is also possible that each valve could be designed to activate at different absolute pressures such that the location and/or timing of activation of each valve can be selected. Utilising multiple independent float valves in a single tool may also offset for the fact that float valve 230 does not provide any indication at surface that the valve has activated.

An operator may also determine that a float valve 230 is working by looking at the fluid displaced by the pipe.

Figure 12:
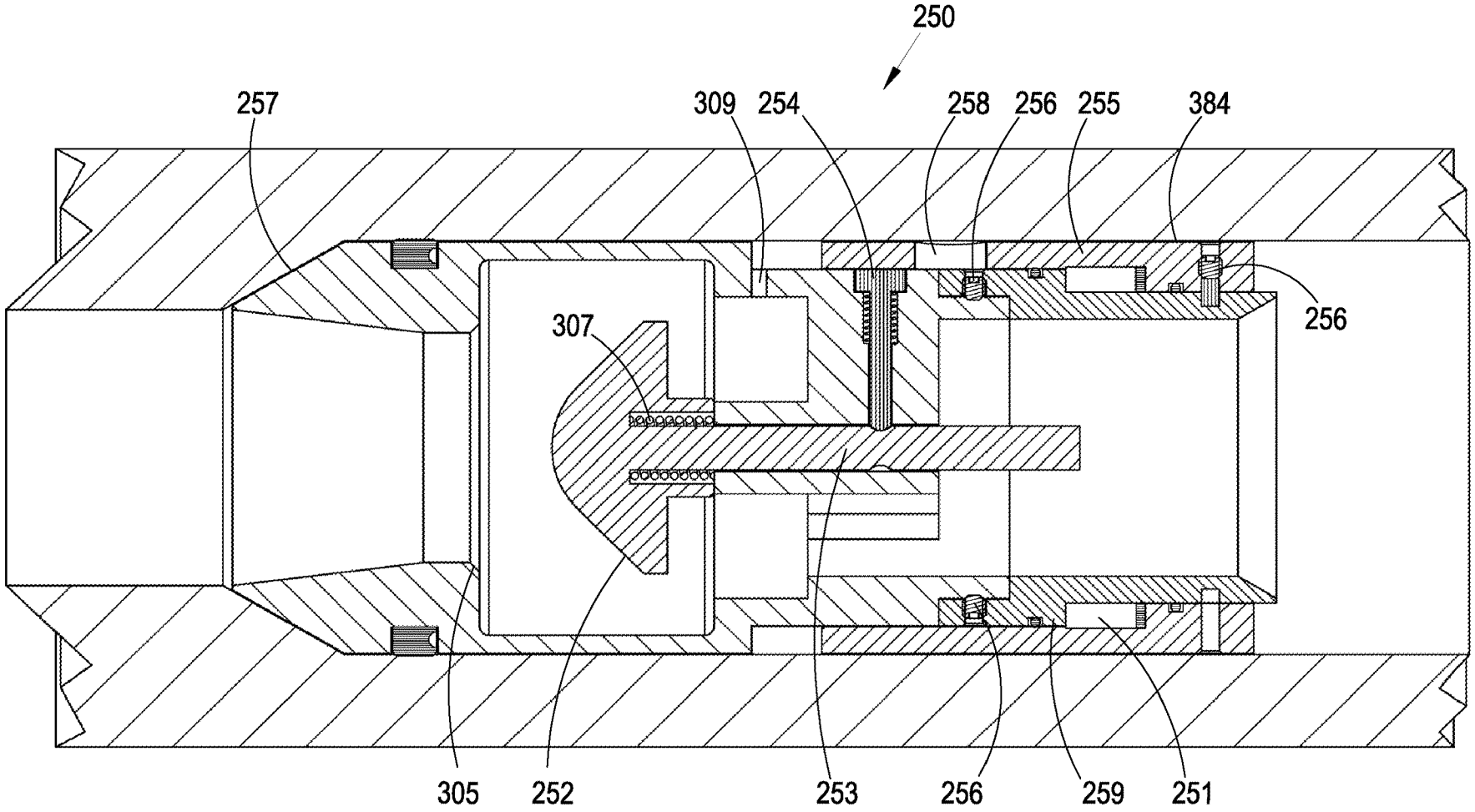
FIG. 12 is an alternative float valve according to an embodiment of the disclosure.

An alternative float valve 250 is illustrated in FIG. 12. In this instance, the float valve is a poppet/plunger/NRV type valve 252. Three arms hold the central opening for the shaft 253 of the poppet 252, one of which has a spring-loaded retaining pin 254 within in. Hydraulic switch 384 is positioned below the poppet 252 and is similar to hydraulic switches 84, 284. Shear pins 256 retain the inner sleeve 259 and outer sleeve 255 of the switch 384 and an annular chamber 251 is formed between the sleeves. As shown in FIG. 12, one shear pin is missing as a way of pre-selecting the pressure at which the remaining pins will shear.

Once the selected absolute pressure is reached, pins 256 will shear and the outer sleeve 255 is moved upwards (to the left in FIG. 12) as chamber 251 closes. Opening 258 then aligns with retaining pin 254 such that the pin 254 moves radially outwards and releases the shaft 253 of the poppet 252. The poppet 252 is then released and will move into engagement with a seat 305 formed on the body under the action of spring 307, preventing upwards flow through the valve 250. As such, the sleeve 255 acts a float valve retainer in this arrangement.

A small vent hole is 309 provided in the upper housing to prevent pressure locking as the sleeve 255 moves upwards. The valve 250 is also provided with a tapered nose 257 to prevent the valve being placed in the wrong way.

In some circumstances, a poppet valve is considered to be more reliable than a flapper type valve, however such valves do not allow for through-bore access.

Those of skill in the art will also recognise that the hydraulic switch 84 may have utility in other applications. For example, the illustrated switch is utilised as a detent, for holding the tube-release flapper 80 in a retracted position. Of course the switch could be utilised for releasably retaining another member or part. For use as a detent the switch is only required to provide a limited degree of travel, however by providing a longer chamber 96 it is possible to provide a greater degree of travel.

The pressure differential between the atmospheric chamber 96 and the hydrostatic pressure in a deep bore may potentially create a very significant pressure force. In one illustrated example the switch is operated at relatively shallow depth, however in other applications the switch could be configured to be released only in response to significantly higher pressures. The resulting pressure differentials may be utilised to create a significant force or may be utilised to accelerate a mass and then utilise the kinetic energy or momentum of the moving mass.

The significant pressure forces which may be generated also require care to be taken to retain the parts of the switch in the initial relative position, to avoid an accidental or premature release. Thus, multiple release mechanisms may be provided.

Figure 13:
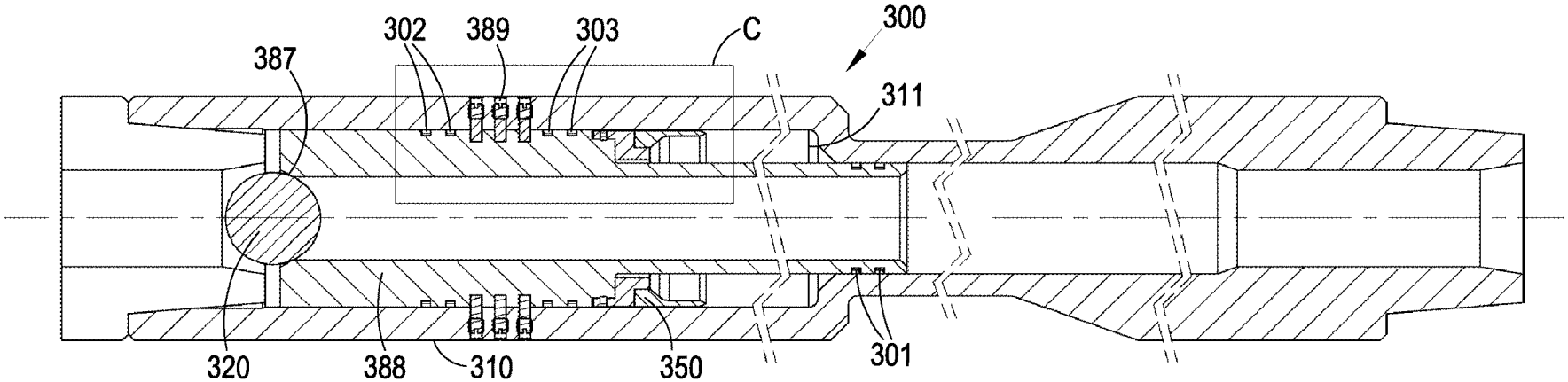
FIG. 13 is a cutting tool according to an embodiment of the disclosure.

A cutting tool 300 which utilises the force generated as mentioned above is shown in FIGS. 13 and 14. In the conventional manner the tool 300 is illustrated such that the box to the left hand-side of FIG. 13 is the top of the tool such that flow from surface will travel left to right. Gutting tool 300 is run in the hole and will remain dormant until ball 320 is dropped downhole to initiate the severance sequence.

Similarly to previous embodiments, an annular chamber 396 is formed between the tool body 310 and a sliding sleeve 388. During assembly at surface a volume of air at atmospheric pressure will be trapped in annular chamber 396. This volume of air is utilised to provide power to sever the tool 300. As the tool 300 is run in hole, the hydrostatic pressure both in and around the tool will increase but air within chamber 396 is maintained at atmospheric pressure by the presences of seals 301 and 302 positioned at either end of sleeve 388. Inside annular chamber 396, a hard ceramic or tungsten circular knife 350 is glued to a metal retainer 352, which is in turn retained by a grub screw 354 to the sliding sleeve 388.

Two set of seals 301 and 302 are present and are in contact with the inside surface of body 310 at different diameters. As such, the left hand-side of sliding sleeve 388 will experience hydrostatic pressure on the outside while the inside of the sleeve experiences effectively nothing. The resulting difference in pressure is multiplied across the annular cross-section of the tool and will generate a significant pressure force on the sleeve 388 from the left to the right of the sleeve, relative to the body 310. For example, in a 5"×3" tool the annular cress-section is 12.5 sq-in meaning a pressure difference of 5000 psi would create 62,500 lb-force (28.4 metric tonnes). It is not unusual for the hydrostatic pressure in some wells to reach more than 25,000 psi on occasion and therefore, it can be seen that there is a large source of force to be utilised. Smaller tools would have smaller annular cross-sectional areas and hence smaller forces will be generated, smaller sleeves would be used and the amount of energy produced will be smaller. However, smaller tools will be proportionally easier to cut.

Figure 14:
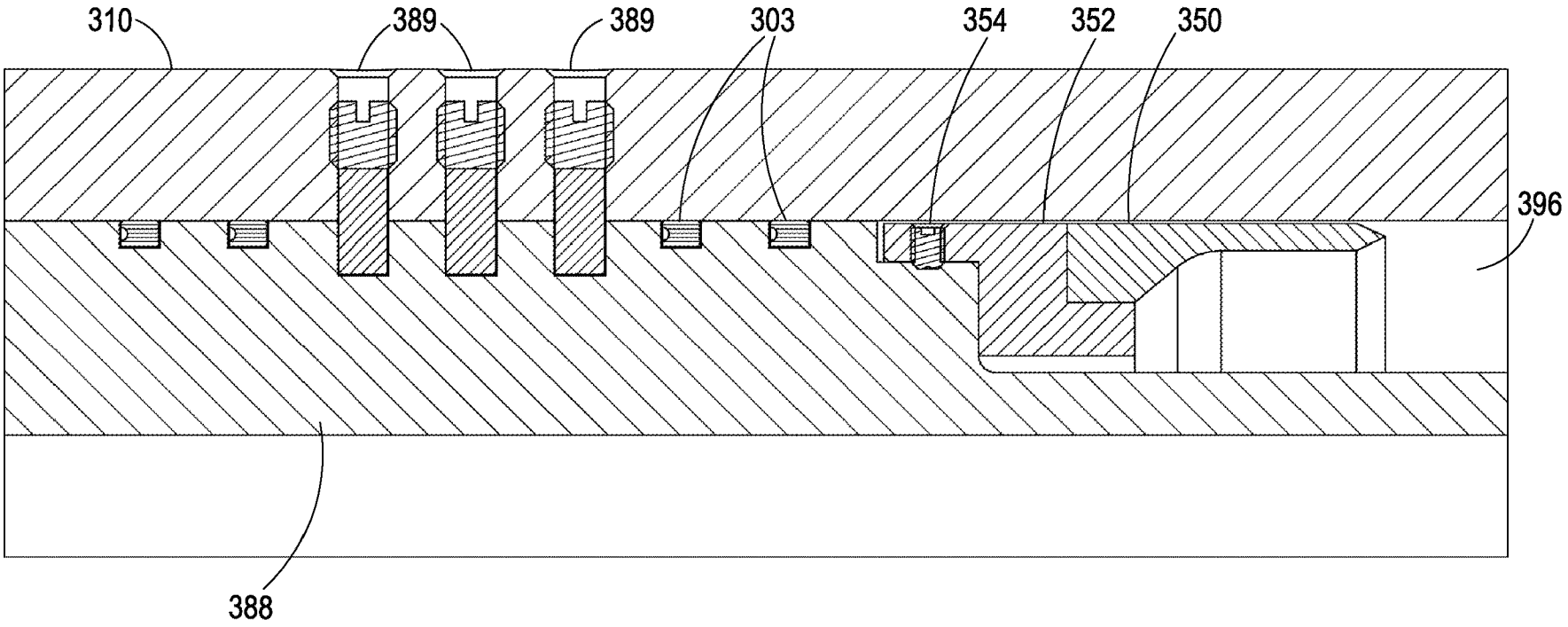
FIG. 14 is an enlarged section view of area C of FIG. 13 illustrating.

The sleeve 388 is retained in the position as shown in FIGS. 13 and 14 by a series of shear pins 389. The shear pins 389 are spaced both axially and radially to provide a sufficient retaining forces to prevent the sleeve 388 from moving. The shear pins are selected to be stronger than the expected hydrostatic pressure in the well, which is generally predictable. A pair of seals 303 is also in place to seal the shear pins from internal to external pressure.

If, for any reason, severance was required, ball 320 is dropped from surface. The ball 320 will be sized to sit on the seat 387 of annular sleeve 388, occluding the sleeve 388. The operator would then apply pressure above the ball by pumping. This will increase the force applied to the sleeve 388 causing shear pins 389 to shear. Once sheared, the annular chamber 396 will effectively collapse under hydrostatic pressure as sleeve 388 accelerates very rapidly to the right, as per the constant acceleration formula (F=ma, s=ut+½ut2 eta), There will be almost no damping provided by the annular chamber 296 on the sleeve 388 as the chamber is closed. As the sleeve 388 moves to the right, circular knife 350 will pierce body 310 at position 311.

Ball 320 will initially assist in accelerating the sleeve as the high pressure fluid above the ball 320 rapidly expands as sleeve 388 moves to the right in the drawings. However, as the ball moves, the fluid in the well below the ball 320 needs to "accelerate" as well and as result, the fluid in the well below the ball 320 provides a significant damping force on the ball 320 as this fluid is compressed. As noted above, there is very little damping provided on the sleeve 388 meaning sleeve 388 will accelerate faster, lifting the ball 320 from the seat 387 such that at this point the ball 320 will provide no more assistance.

The energy created by the release of the sleeve 388 and subsequent rapid collapse of chamber 396 is proportional to the length of travel of the sleeve. This can be regarded as pure work, i.e. force x distance. Therefore, the longer the distance of travel of the sleeve 388, the faster it will become and the more energy will be generated for the knife 350 to affect a cut. If the mass of the sleeve is increased, the sleeve will not reach as high speeds but the sleeve would have more momentum. This could be useful in some operations. The acceleration on the sleeve 388 is likely to be hundreds of times more than gravity, perhaps as much as a thousand G, and an impact speed of 1000 mph is possible on, for example a 30 ft (9 m) travel, especially in high pressure wells.

The body 310 of cutting tool has been shaped such that circular knife 350 only has to travel a relatively short distance to pierce the body 310 whilst still being significantly strong. However, other geometries are envisaged, a few examples of which are also discussed below.

Figure 15:
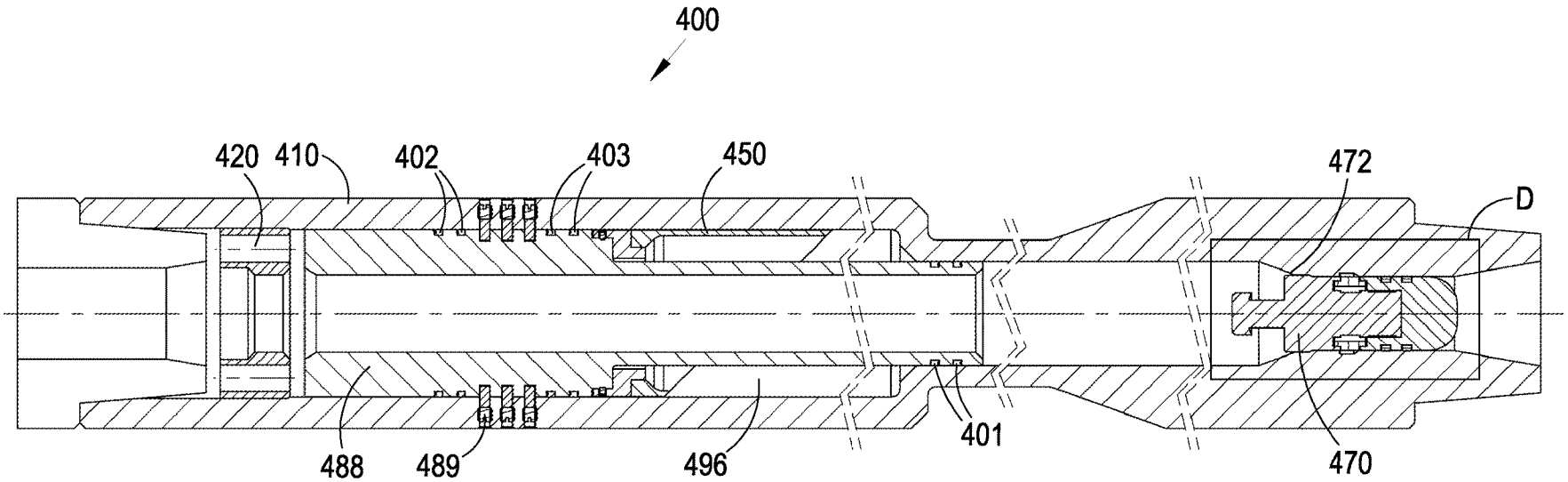
FIG. 15 is an alternative cutting tool according to an embodiment of the disclosure.

Another cutting tool 400 according to an embodiment of the disclosure is illustrated in FIG. 15. Similarly, cutting tool 400 utilising the energy generated from the closure of annular chamber 496 to pierce body 410 with circular knife 450. The cutting knife 450 has more elongate shape than knife 350 and as such, the impact force of the knife will be initially concentrated on the nose of the knife 450, piercing on one side of the body 410. If the knife 450 does not pierce entirely through the body 410, the body will be sufficiently weakened to allow an operator to tear the rest of the circumference, if, for example, the tool was stuck or anchored.

Sleeve 488 is retained by shear pins 489 similarly to above. Two set of seals 401 and 402 are present and are in contact with the inside surface of body 410 at different diameters and a pair of seals 403 is also in place to seal the shear pins from internal to external pressure. When severance is required, activating dart 470 is dropped from surface and is translated through the sleeve 488 into seat 472 below. As such, more pressure is required to shear pins 489 since the force is acting on a different area compared to the embodiment of FIGS. 13 and 14. However, in this arrangement, there will be more cutting energy generated because the absolute pressure in the tool will be the total of hydrostatic energy plus the exerted energy from surface to above the activating dart 470 when the sleeve 488 in in the initial position as shown in FIG. 15.

Unlike the previous embodiment, none of the energy generated by the sleeve 488 moving to close chamber 394 will be used to accelerate the rest of the mud/fluid system because the activating dart 470 occludes the tool below the sleeve 488. Thus none of the energy of the cutting stroke is wasted so to speak. Similarly to above, energy created by release of the sleeve 488 and subsequent rapid closure of chamber 496 is proportional to length of travel of the sleeve 488.

As the sleeve 488 travels and closes chamber 496, there will be a reduction of pressure at surface as the volume of fluid above the activating dart 470 increases. However, if the volume required to compress the contents of the string is more than the volume of chamber 496, this will provide a net gain in terms of energy to the cutting stroke since the tool will require more volume of fluid to be pumped to reach the desired pressure.

For example, if the hydrostatic pressure was 5000 psi and the extra pressure from pumping fluid from surface was also 5000 psi, and the volume of fluid required to compress the contents of the string to 5000 psi was double that off annular chamber 496, the pressure at the beginning of the cutting stroke, immediately after pins 489 have sheared would be 10,000 psi (125,000 lb) and at the end of the cutting stroke, the pressure would be 7,500 psi (93,750 lb).

Therefore, the longer the cutting tool, the longer the cutting stroke (the length of travel of the sleeve to cut the body) and the deeper the position of the tool in the well will all provide additional energy to the cutting stroke.

A bypass catcher sleeve 420 is provided above the sleeve 488 to prevent anything inadvertently landing on the sleeve, for example a ball, and blocking sleeve which could result in erroneous activation of the cutting tool to cut the body 410. The provision of a bypass catcher sleeve 420 is one of several safety mechanisms which can be utilised with cutting tools of the present disclosure to protect against erroneous activation of the cutting tool.

Figure 16:
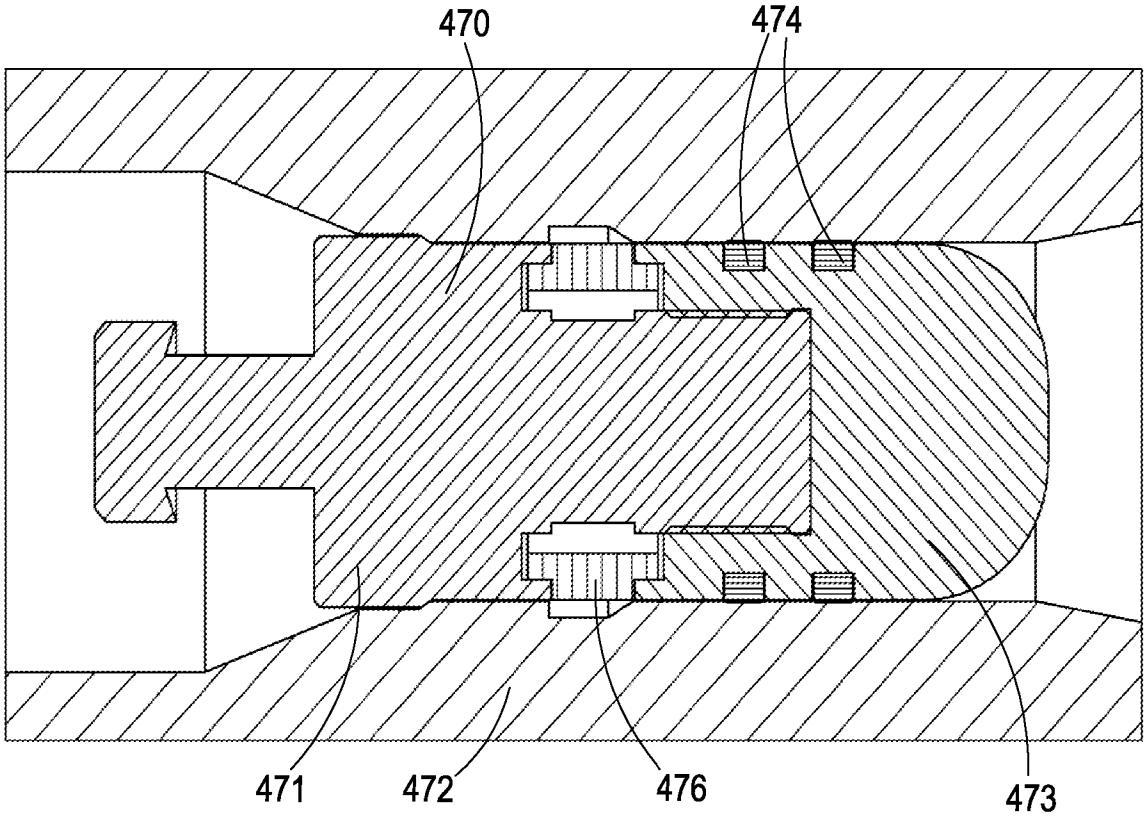
FIG. 16 is an enlarged view of the activating dart engaged in area D of FIG. 15.

An enlarged view of an activating dart 470 engaged in activation seat 472 of cutting tool 400 is shown in FIG. 16. Activating dart 470 is a fishable dart and will land on seat profile 472 which is located just above the pin of tool 400. Dart 470 is sized to fit through the bypass catcher sleeve 420, the cutting tool sliding sleeve 488 and will seal on the seat profile 472. Two redundant seals 474 are provided in the lower section 473 of the dart and a blank sleeve 476 is retained between the upper section 471 and lower section 473 which are threadedly connected.

Figure 17:
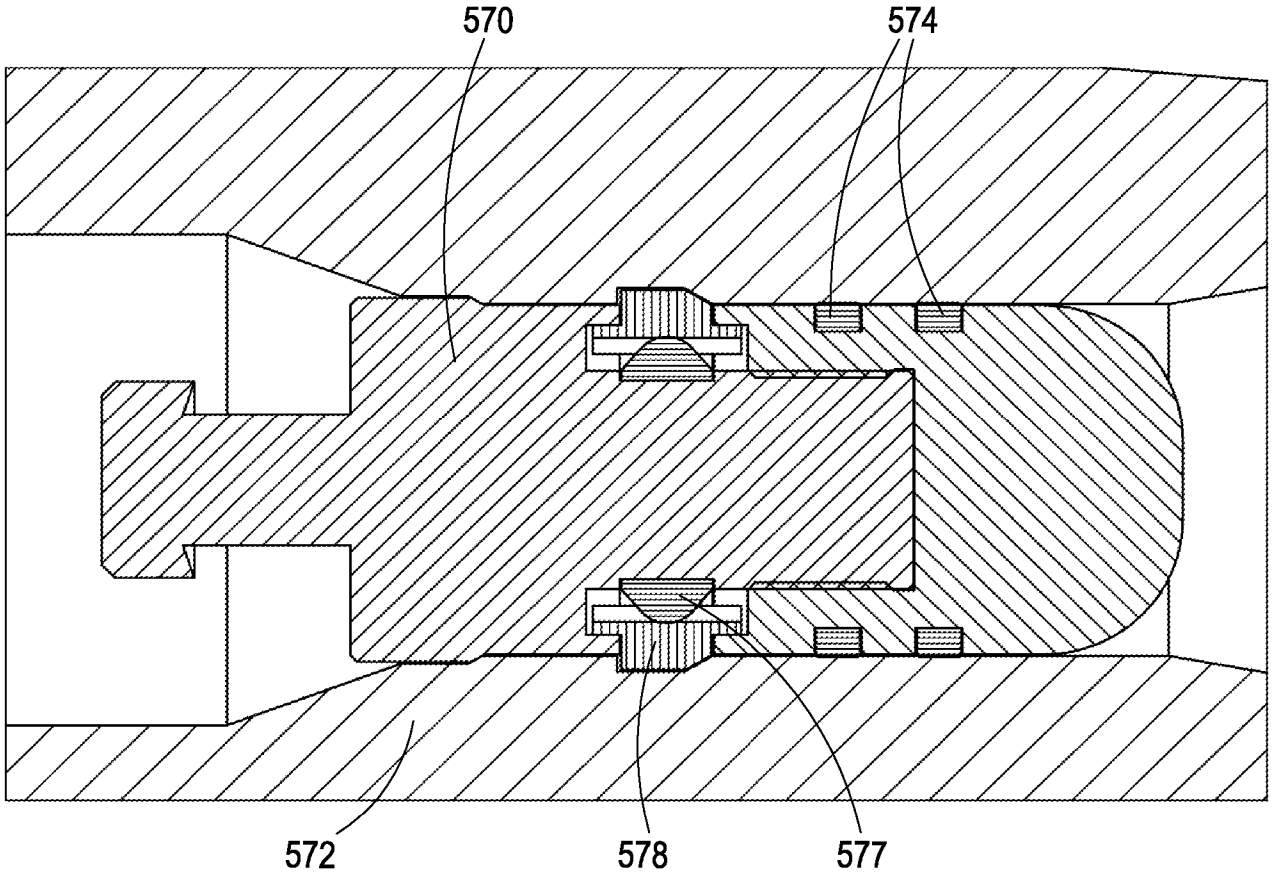
FIG. 17 is an alternative activating dart according to an embodiment of the disclosure.

Alternative activating dart 570 is provided in FIG. 17. Activating dart 570 is also sized to pass through bypass catcher sleeve 420 and sliding sleeve 488 and comprises latching dogs 578 which are biased outwards by ring member 577. Ring member 577 may comprise, for example, hard rubber. Activating dart 570 is not fishable because latches 578 will hold the dart in place with seat profile 572. Seal 574 provide for pressure to be held from below. In certain circumstances, it may be extremely desirable to plug and seal off the tool internally prior to severance.

An activating dart which is both fishable and able to seal off pressure from below is also envisaged.

It may be desirable to prevent erroneous activation of the cutting tools of the present disclosure. In an drilling environment, severe vibrations of the string could weaken the shear pins of the cutting tool, especially jarring which is likely to happen in the event of the drill string being stuck. Therefore, at least one safety mechanism may be used in conjunction with the cutting tool in order to prevent activation.

Figure 18:
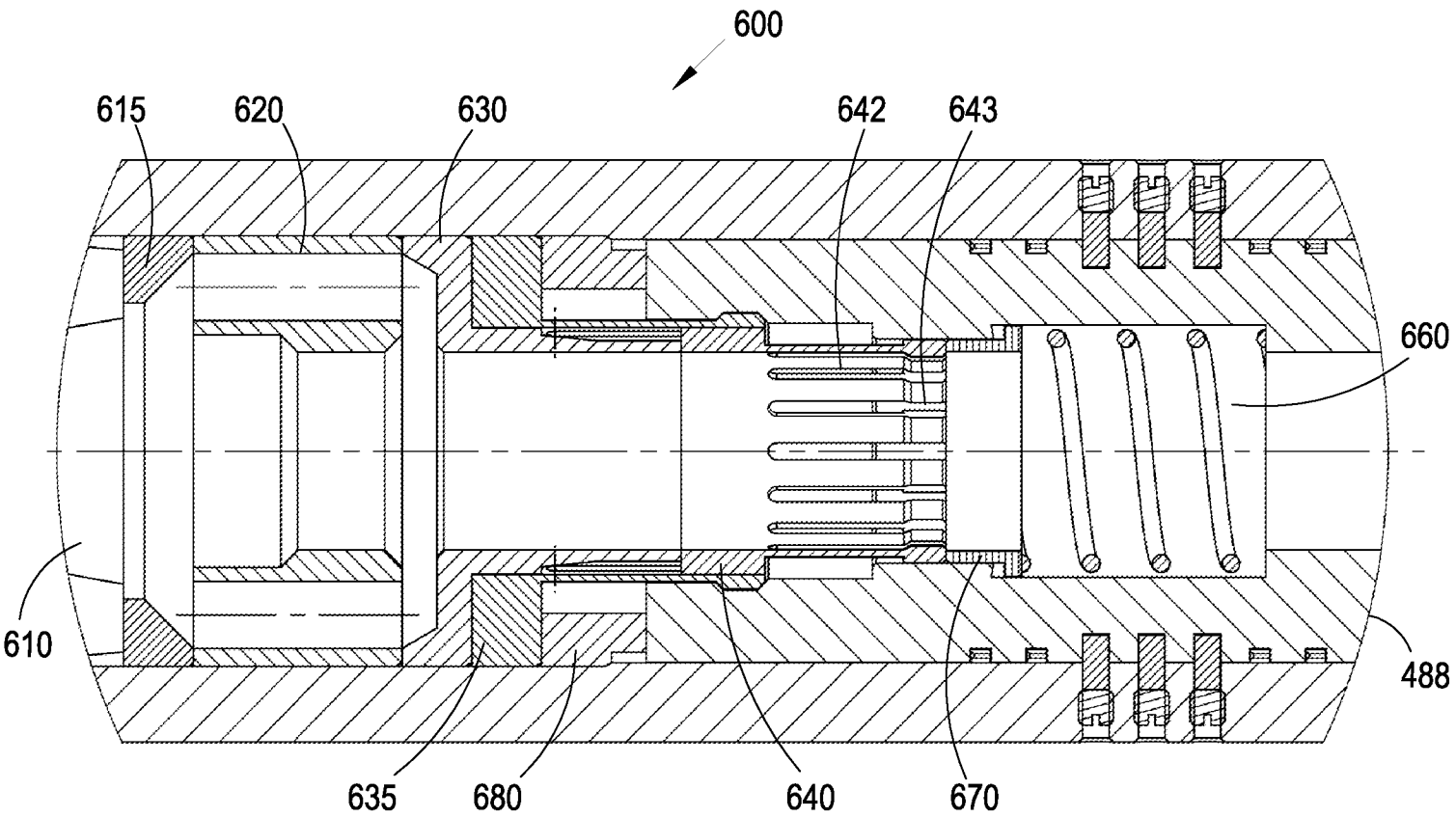
FIG. 18 is a safety mechanism for use with a cutting tool according to embodiments of the disclosure.

FIG. 18 shows an example of a safety mechanism which can located within sliding sleeves 488. The safety mechanism works to prevent the shear pins 389, 289 from shearing by preventing the sleeve from being able to move up or down until the correctly sized activating dart 470 passes through the safety mechanism to release it. The activating dart 470 will be exactly the right diameter and profile to release the safety mechanism.

Safety mechanism 600 comprises a tapered sleeve 615 which is shimmied to provide a perfect axial fit and a bypass catcher sleeve 620 which is essentially the same as bypass catcher sleeve 420. A retaining collet 640 is positioned within the mechanism 600 with a profiled sleeve 635 configured to fit around the retaining collet. A tapered spacer sleeve 680 is provided and is shimmied to retain tile collet 640 and sliding sleeve 488 in position. Spacer sleeve 680 sits on a small shoulder provided in the body of the cutting tool 400. A further profiled spacer 630 is also provided so that it is sized to provide the correct fit between the bypass catcher sleeve 620 and the profiled sleeve 635.

Retaining collet 640 comprises retaining collet fingers which are recessed into a groove provided on the sliding sleeve 488. This prevents the sliding sleeve 488 from moving until activated. The collet seat 642 comprises a ring which sits inside the retaining collet fingers 644, preventing release of the fingers. At the opposite end of the collet seat, a spring loaded collet is provided which is biased radially outwardly and is initially prevented from moving radially outwards by the bore of sleeve 488. Collet seat fingers 643 protrude inwardly into the bore such that when an activating dart lands on them, the dart would push them downwards as it lands on the collet seat 642. An L-shaped spring washer 670 and spring 660 is provided to urge the collet seat timers 643 upwards from below, thus acting to prevent retaining collet fingers from releasing the sleeve 488 until it is desired to do so.

When cutting is required, activating dart 470 is dropped downhole and the dart will pass through the bypass catcher sleeve 620 landing on collet seat 642. This will push the collet seat fingers 643 downwards, compressing the spring 660. As the spring 660 is compressed, the collet seat 642 will stop supporting the retaining collet fingers 644 allowing them to release. The collet seat fingers 643 will move radially outwards into the recess of the spring cavity, releasing the dart to travel onwards to the dart seat 472 to activate the cutting tool. Since collet seat fingers 643 are biased outwardly, they will latch into the spring recess, leaving the retaining collet finders 644 free. Activating dart 470 will land on dart seat 472, and the tool can be pressured up to shear the shear pins 489 to sever the pipe as desired.

Figure 19:
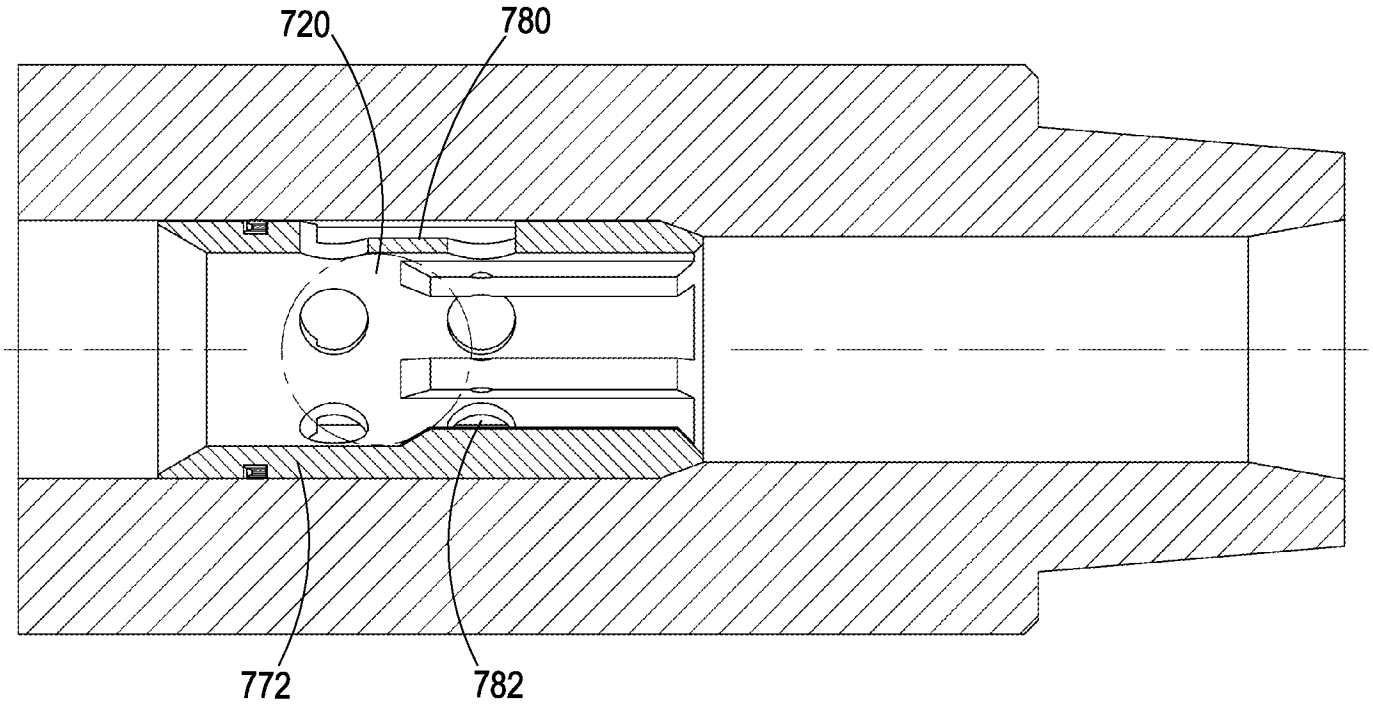
FIG. 19 is an alternative seat arrangement for use with a cutting tool according to embodiments of the disclosure.
Figure 20:
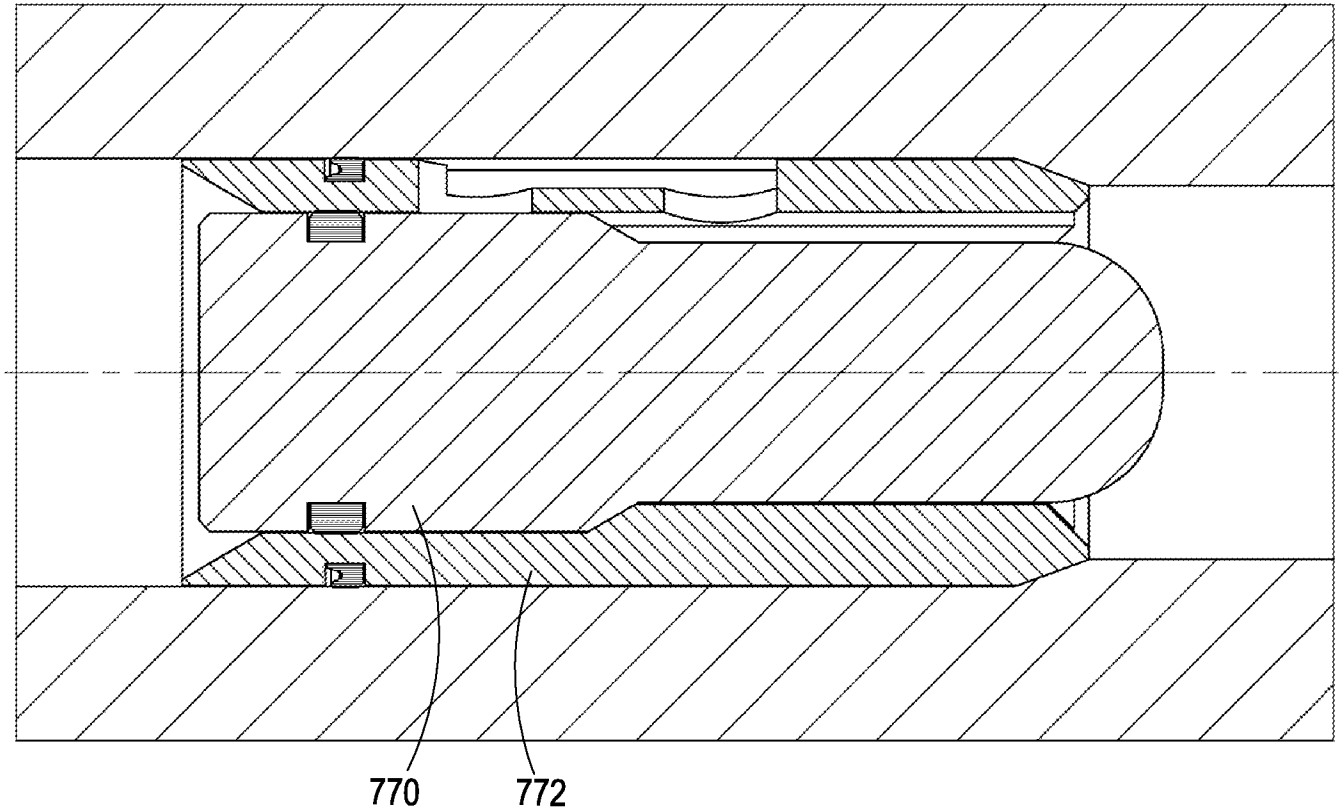
FIG. 20 illustrates an activating dart engaged with the seat of FIG. 19.

A further safety mechanism may be provided in the form of a vented seat 772 for receiving the activation dart, as shown in FIG. 19. Vented seat 772 will be positioned below the cutting tool, as per seat 420 and can provide an additional means to prevent activation of the cutting tool against accidental activation. If a ball 720 of exactly the same diameter of the activating dart 770 is dropped, this would not activate the cutting tool because the seat 772 provides for venting around such a ball 720 by the provision of vent holes 782 and bypass 780. For example, if the vented seat 720 is combined with the safety mechanism 600 and the cutting tool 400, in the event of a ball 720 passing through the bypass catcher sleeve 620, the ball would may unlock the safety mechanism 600 but it would not allow for activation of the tool 400. In the event of slightly smaller diameter ball being dropped downhole, the safety mechanism 600 would not unlock but the seat 772 would catch still catch the smaller ball and activation of the cutting tool would still be prevented. FIG. 20 illustrates a correctly sized activating dart 770 engaged with the seat 772. The dart 770 will seal with the seat 772 and allow for the tool to pressured up to activate the cutting tool.

Figure 21:
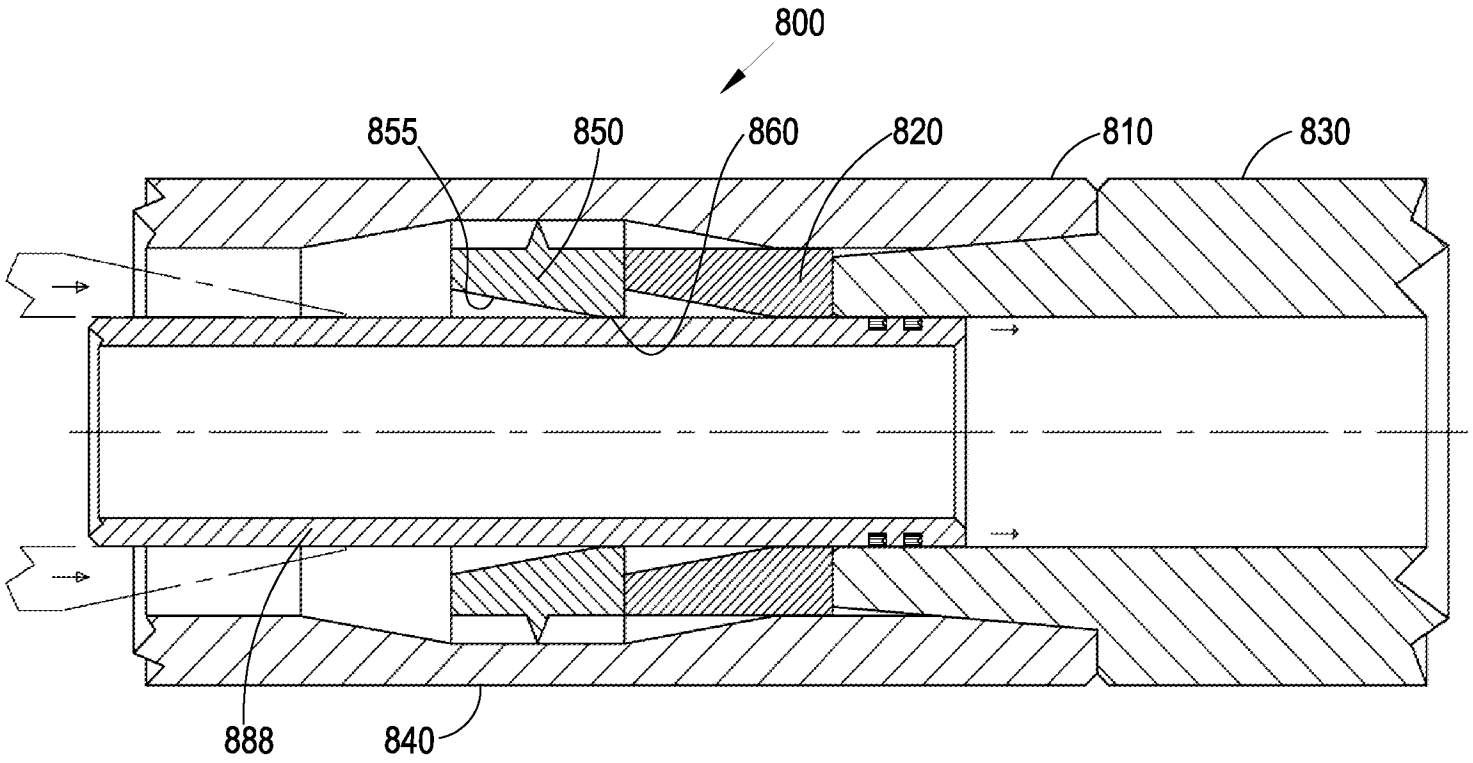
FIG. 21 illustrates an alternative cutter arrangement for a cutting tool according to embodiments of the disclosure.

An alternative cutting arrangement 800 is illustrated in FIG. 21 where the cutting implement is a segmented knife 850 that is orientated to point radially outwards. The knife 850 is formed from a hard material, for example, ceramic, tungsten or hardened steel. The segments have a tapered inner bore 855 which has a mating taper 860 on the far end on the inside of movable sleeve 888. A support ring 820 positioned behind the knife 850 is also formed from a very hard material in order facilitate the diversion of ail of the linear momentum generated by the sleeve moving into sideways motion for the knife 850.

The tool may be activated similarly to previous embodiments, wherein the sleeve is rapidly accelerated to a high speed. The momentum generated from this movement forces the knife 850 outwards on impact through use of a wedging effect. The point 840 at which the knife pierces the wall is relatively thin. This may present an issue in deep water wells where the hydrostatic pressure may approach the collapse pressure of the body. The tool 800 is shown comprising a pin 830 and box 810 connection which may allow for easier machining of the inner groove because of its proximity to the end. The end of the pin 830 can also be utilised as a stopper. Whilst in the embodiments shown, the tool is activated using an activating device, it will be appreciated that alternative forms of activation are also envisaged. For example, the tool may be activated using various signals, for example RFIDs, pressure pulses, accelerometers, or any form of remote signals suitable for use in activating downhole tools. These may be used alternatively to or in combination with an activation device.

Figure 22:
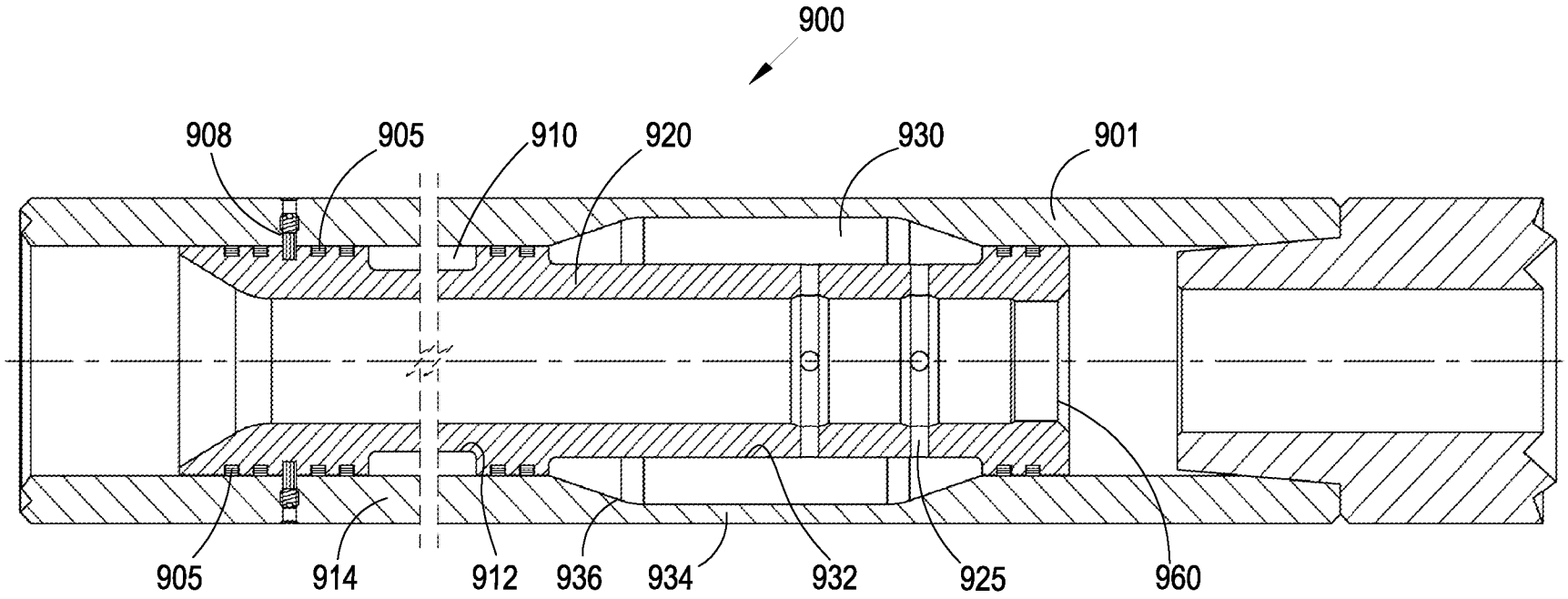
FIG. 22 illustrate a cutting apparatus according to another embodiment of the disclosure.
Figure 23:
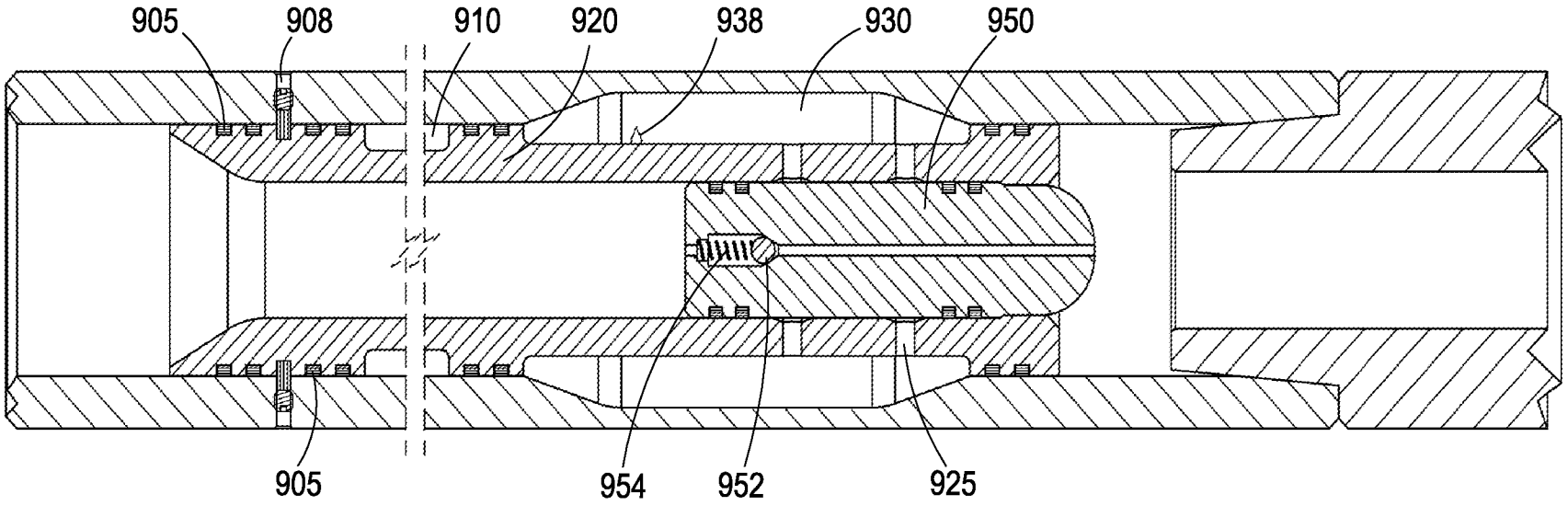
FIG. 23 illustrates an activating dart engaged in the cutting apparatus of FIG. 22.
Figure 24:
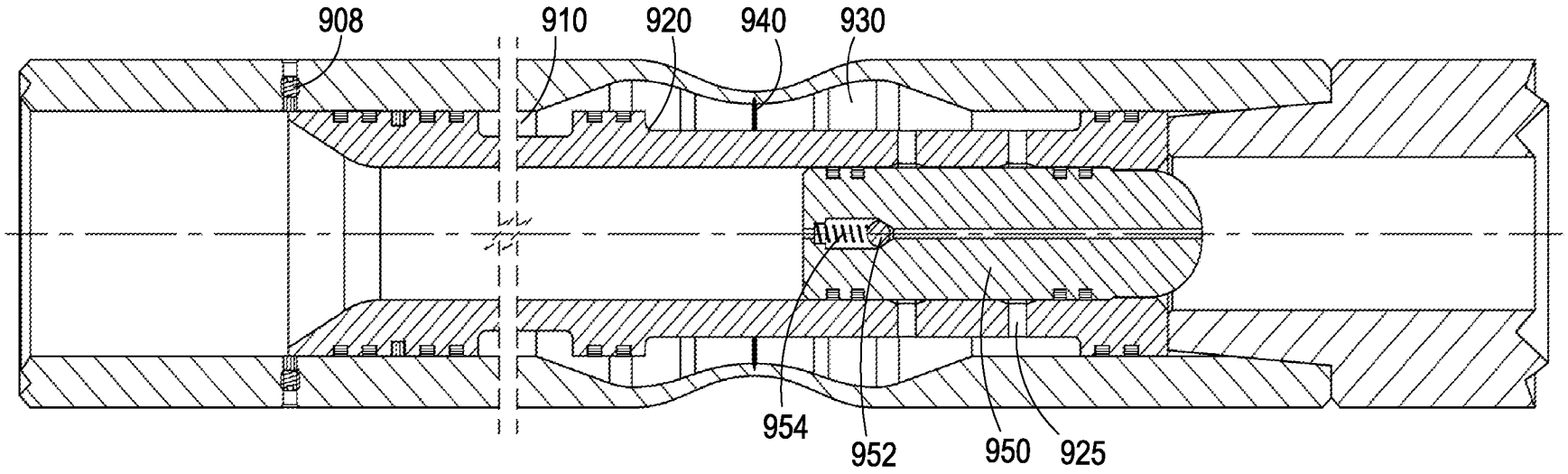
FIG. 24 illustrates the cutting apparatus of FIG. 22 severing the outer wall of the body.

An alternative cutting tool embodiment which utilises hydrostatic pressure to sever the pipe body and thus the string by collapsing a chamber formed within the tool is shown in FIGS. 22 to 24. The tool 900 comprises an elongate sliding sleeve 920 which forms a first chamber 910 and a second chamber 930 between the sleeve 920 and the body 901. The sleeve 920 is initially retained by several radially spaced shear pins 908 near the top (left hand side of the tool in FIG. 22) end of the tool. The shear pins 908 are similar to those described in previous embodiments which are selected to shear upon exposure to a selected pressure, although shear pins 908 are not required to be as strong as previous embodiments.

The first chamber 910 contains air at atmospheric pressure and is securely sealed by seals 905 at either end of the chamber 910. As an example, the inner wall 912 of the first chamber 910 may be 4.75 in (121 mm)×3.35 in (85 mm) which if formed from standard API material with a 120 ksi yield means the inner wall can withstand 35 ksi collapse pressure (241 MPa). The outer wall 914 of the first chamber may be 8.5 in (216 mm)×6.0 in (152 mm) and has a similar collapse pressure of 30 ksi (207 MPa).

The second chamber 930 is configured to have a stronger inner wall 932. The second chamber 930 is vented to the inside of the tool 900 by 2×4 ports 925 formed in the sleeve 920. The outer wall 934 has a groove 936 which is angled and has an internal radius to minimise the stress concentration at this change of section of the body 901. This means that the outer wall 934 of the second chamber is thinner waned, compared to the outer wall 914 of the first chamber. The outer wall 934 may be 8.5 in (216 mm)×7.5 in (190 mm) and having a collapse pressure of 13.3 ksi (92 MPa). However, whilst this outer wall 934 is relatively thin, it will still be extremely strong and able to hold 1.5 million pounds force (682 Tonnes). There will also be no issues with torque because of the large diameters.

The tool 900 may be used in deep water drilling where for example, the hydrostatic pressure is 15-20 ksi. If the tool 900 was to become stuck, or if it was decided to sever the pipe and abandon the BHA, activating dart 950 may be dropped downhole. Dart 950 will land on seat 960 and seal off the ports 925 in the sleeve 920. With the dart 950 in this position, the second chamber 930 is now completely sealed off with a volume of mud at at least hydrostatic pressure, for example 17 ksi. Assuming that the string is not plugged off, applying pressure from above to a pre-selected value will shear the shear pins 908 and the sleeve 920 will translate downwards. A ball 952 and a weak spring 954 are provided in the activating dart 950 to allow for pressure to be relieved from below such that in the event that the string was plugged from below, repeatedly pressuring up from surface would shift the sleeve 920 bit by bit.

When the sleeve 920 has moved to its final position as shown in FIG. 24, the first chamber 910 will be in fluid communication with the second chamber 930 such that high pressure mud from the second chamber 930 will leak into the first chamber 910 and the second chamber will depressurise down to atmospheric pressure. The outer wall 934 of the second chamber 930 is configured such that it will not be able to withstand hydrostatic pressure from outside of the tool and the wall 934 will collapse radially inwards. The volume of the first chamber 910 is selected to maximise the inward movement of the outer wall 934 of the second chamber 930 as the second chamber depressurises. The inward collapse of the outer wall 934 is configured such that the wall at this point may sever. If the body 901 does not fully sever, an overpull and torque can be applied to the body 901 facilitating complete separation at this point.

It will be appreciated that alternative forms of activation are also envisaged for tool 900. For example, the tool 900 may be activated using various signals, for example RFIDs, pressure pulses, accelerometers, or any form of remote signals suitable for use in activating downhole tools. These may be used alternatively to or in combination with an activation device.

Figure 25:
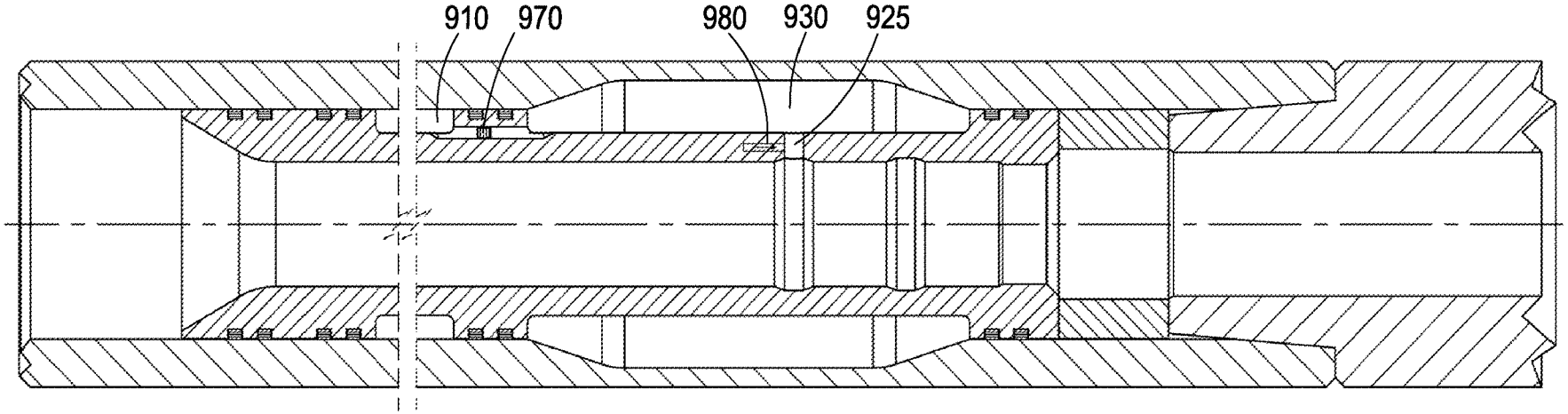
FIG. 25 illustrates an alternative cutting apparatus according an embodiment of the disclosure.

Alternatively, the second chamber may be configured to be sealed by closing a valve 980 in communication with vent 925. The apparatus may comprise a valve 970 located between the first 910 and second chambers 930 as shown in FIG. 25, wherein a valve member is moved to an open position once the second chamber is sealed, in order to allow fluid communication between the first and second chambers. With the valve member 970 in the open position, the second chamber will depressurise down to atmospheric pressure and the outer wall of the chamber will collapse radially inwards. The valves may be, for example, signal operated, or mechanically operated.

It may also be useful to include a cutting instrument within the second chamber 930, such as a knife 938. The knife 938 may be singular, or a multiple of the full circumference to assist in severing the tool 900. The outer wall 934 inner surface will already be highly stressed and plastically stretched due to over-stressing as the chamber 930 collapses, this may result in crack 940 occurring in the outer wall 934. The cutting implement 938 could also provide the crack 940.

The diameters of the tool provided above are merely exemplary and can be modified to change the working pressure envelope. For example, the material selected for use in the tool could be stronger (for example, 150 ksi) or weaker (for example, 95 ksi) to suit well hydrostatics. However, this particular embodiment may be more suited for use in large deep water wells. In low pressure wells, the outer wall of the second chamber would need to be sufficiently thin to enable over-stressing and this thickness may or may not be suitably strong enough for normal use, for example the outer wall may end up being weaker than a downhole connection in the well.

Although cutting tool 900 is effectively fail safe in that, in the event that the sleeve were to shift inadvertently, the pipe would not sever because the energy would dissipate harmlessly since the ports 925 would not be sealed, it may still be desirable to provide tool 900 in combination with the secondary activation mechanisms outlined above. For example, the tool 900 may be provides with a bypass valve seat similar to 620, a retaining collet similarly arranged as retaining collet 640, and/or the activation profile may be vented such that only the correct activation device seals on the profile. This is in contrast with the other cutting tool embodiments described where inadvertent activation of the tool would result in the pipe being cut.

Whilst the above embodiments have been described using shear pins as releasable retaining means for the sleeves, the skilled person can appreciate that any suitable form of releasable retaining means could be utilised instead of, or in conjunction with the shear pins. For example, a releasable collet arrangement may be configured to release the sleeve under the conditions described above.

The invention claimed is:

1. Downhole apparatus comprising:

a tubular body for incorporation in a tubing string, the tubular body defining an axially extending though bore;

at least one float valve mounted in the tubular body, the float valve having a first configuration in which the at least one float valve is inoperable and permits flow down through the tubular body and permits flow up through the tubular boy and the float valve having a second configuration in which the at least one float valve is operable and permits flow down through the tubular body but prevents flow up through the tubular body; and a float valve retainer having a first configuration in which the float valve retainer maintains the at least one float valve in the first configuration and the float valve retainer having a second configuration in which the float valve retainer permits the at least one float valve to be reconfigured to the second configuration, the float valve retainer being reconfigured from the first configuration to the second configuration by exposure of the float valve retainer to a selected absolute pressure from fluid in the axially extending through bore.

2. The apparatus of claim 1, wherein the float valve retainer is operatively associated with a chamber containing compressible fluid and the selected absolute pressure creates a pressure differential between the axially extending through bore and the chamber, the pressure differential reconfiguring the float valve retainer from the first configuration to the second configuration.

3. The apparatus of claim 2, wherein the float valve retainer comprises a retaining member and the selected absolute pressure creates a pressure differential between the axially extending through bore and the chamber sufficient to release and translate the retaining member and compress the compressible fluid contained in the chamber.

4. The apparatus of claim 2, wherein the chamber contains air at atmospheric pressure.

5. The apparatus of claim 1, wherein the float valve retainer comprises a flow restriction configured to permit creation of a pressure differential across the restriction in response to fluid flow through the axially extending through bore and the pressure differential reconfiguring the float valve retainer to permit operation of the float valve, the flow restriction having a first configuration in which the flow restriction is inoperable and a second configuration in which the flow restriction is operable to permit creation of the pressure differential, the flow restriction maintaining the first configuration until exposed to the selected absolute pressure.

6. The apparatus of claim 5, wherein the flow restriction is configured to be subsequently from the second configuration to a third configuration in which the flow restriction is inoperable.

7. The apparatus of claim 5, wherein the flow restriction comprises a valve member.

8. The apparatus of claim 7, wherein the first configuration the valve member extends along an axis parallel to a longitudinal axis of tubular body.

9. The apparatus of claim 7, wherein in the second configuration the valve member lies perpendicular to a longitudinal axis of the tubular body.

10. The apparatus of claim 7, wherein the valve member is rotatable from a first position in which the valve member is retracted and inoperable, to a second position in which the valve member is extended and operable, and then to a third position in which the valve member is retracted and inoperable.

11. The apparatus of claim 5, wherein the flow restriction comprises a pivoted flapper.

12. The apparatus of claim 5, comprising a flow restriction retainer for releasably retaining the flow restriction in the first, the flow restriction retainer being operatively associated with a chamber containing compressible fluid and wherein the selected absolute pressure creates a pressure differential between the axially extending through bore and the chamber sufficient to release and translate the flow restriction retainer and compress the compressible fluid contained in the chamber.

13. The apparatus of claim 12, wherein the chamber contains air at atmospheric pressure.

14. The apparatus of claim 12, wherein the float valve retainer includes a float valve retaining member having a first position for holding a float valve member off a valve seat and preventing the float valve from closing and a second position allowing the float valve member to close.

15. The apparatus of claim 14, wherein the float valve retaining member cooperates with the flow restriction such that a pressure differential across the flow restriction generates a release force on the float valve retaining member.

16. The apparatus of claim 14, wherein the float valve retaining member is releasable in the first position.

17. The apparatus of claim 16, wherein the float valve retaining member is releasably retained in the first position by shear couplings.

18. A downhole method comprising:

(a) running a tubular string part-way into a bored with a float valve in the string maintained in a first configuration and permitting fluid to flow from the bore, through the float valve and into the string;

(b) pumping fluid down the string, through the float valve and into the bore while maintaining the float valve in the first configuration; and (c) exposing the float valve to a selected absolute pressure from within the string and reconfiguring the float valve to a second configuration in which the float valve prevents fluid flow from the bore into the string while permitting fluid flow from the string into the bore.

19. The method claim 18, further comprising self-filling the string with fluid from the bore during step (a).

20. The method of claim 18, further comprising running the string further into the bore between steps (b) and (c), and between steps (b) and (c) self-filling the string with fluid from the bore.

21. The method of claim 18, further comprising commencing drilling of the bore only after completing at least one of step (b) and step (c).

22. The method of claim 18, further comprising, at step (c), running the float valve to a location in the bore where hydrostatic pressure provides the selected absolute pressure.

23. The method of claim 18, further comprising, at step (c), running the float valve to a location in the bore where the float valve experiences a hydrostatic pressure and pumping fluid into the string to increase the pressure in the string whereby the cumulative hydrostatic pressure and pump pressure provides the selected absolute pressure.

24. The method of claim 18, further comprising, with the float valve in the second configuration, biasing the float valve towards a closed configuration whereby the float valve is normally closed.

25. The method of claim 18, further comprising, with the float valve in the second configuration, maintaining the float valve closed in the absence of flow down through the string.

26. The method of claim 18, further comprising, with the float valve in the second configuration, opening the float valve by pumping fluid down through the string.

27. The method of claim 18, further comprising, at step (c):

reconfiguring a flow restriction associated with the float valve from a first configuration in which the flow restriction is inoperative to second configuration in which the flow restriction is operative in response to the selected absolute pressure; and pumping fluid down through the string to create a pressure differential across the flow restriction in the second configuration and thereby reconfiguring the float valve to the operable configuration.

28. The method of claim 27, further comprising, at step (c), running the string further into the bore between reconfiguring the flow restriction from the first configuration to the second configuration and then pumping fluid down the string to create a pressure differential across the flow restriction in the second configuration.

29. The method of claim 27, further comprising, at step (c), reconfiguring the flow restriction from the second configuration to a third configuration in which the flow restriction is inoperative.

30. The method of claim 27, further comprising, at step (c), rotating the flow restriction between the first configuration and the second configuration.

31. The method of claim 27, further comprising, at step (c), rotating the flow restriction between the first configuration and the second configuration, and at or following step (c), rotating the flow restriction to a third configuration in which the flow restriction is inoperative.

32. The method of claim 27, further comprising, at step (c), translating a flow restriction retainer to release the flow restriction and permit the flow restriction to move from the first configuration to the second configuration.

33. The method of claim 27, further comprising, at step (c), pumping fluid down through the string to create a pressure differential across the flow restriction in the second configuration to generate a release force and operate a float valve retainer to reconfigure the float valve to the second configuration.

34. The method of claim 33, further comprising the flow restriction in the second configuration engaging the float valve retainer and axially translating the float valve retainer.

35. The method of claim 33, further comprising releasably retaining the float valve retainer to the float valve and, at step (c), releasing the float valve retainer from the float valve.

36. The method of claim 20, further comprising, at step (c), reducing the volume of a compressible fluid-containing chamber operatively associated with the float valve.

37. The method of claim 36, further comprising, at step (c), utilizing the selected absolute to create a pressure differential to release and translate a flow restriction retainer to compress the fluid in the chamber.

38. The method of claim 36, further comprising at least partially filling the chamber with air at atmospheric pressure.

39. A drilling operation comprising:

(a) providing a drill string assembly comprising a float valve, an under-reamer and a drill bit and mounting the drill string assembly on a drill string;

(b) tripping the drill string and the drill string assembly at least part way into a bore with the float valve in a first configuration in which flow is permitted both up and down through the float valve;

(c) pumping fluid down through the drill string and the drill string assembly while maintaining the float valve in the first configuration;

(d) reconfiguring the float valve to second configuration in which flow down through the float valve is permitted but flow up through the float valve is prevented;

(e) commencing drilling with the drill bit; and (f) translating an activating device through the drill string to activate the under-reamer.

40. The method of claim 39, further comprising locating the float valve above the under-reamer in the drill string assembly.

41. The method of claim 39, further comprising translating the activating device through the float valve.

42. The method of claim 41, comprising locating the float valve below the under-reamer in the drill string assembly.

43. Downhole apparatus comprising: a tubular body defining an axial through bore and comprising a float valve and a float valve retainer for maintaining the float valve in an open configuration, the float valve retainer being reconfigurable in response to an increase in absolute fluid pressure within the axial through bore to permit the float valve to close to prevent flow up through the float valve while permitting flow down through the float valve.

44. The downhole apparatus of claim 43, wherein the float valve retainer is operatively associated with a sealed chamber containing compressible fluid and wherein the increase in absolute fluid pressure within the body creates a pressure differential between fluid in the tubular body and the fluid in the chamber sufficient to reconfigure the float valve retainer and permit the float valve to close.

45. The downhole apparatus of claim 44, wherein the float valve retainer is retained in an initial configuration by at least one of a releasable retainer, a shear coupling, or a plurality of shear pins.

46. The apparatus of claim 1, comprising at least two float valves.

* * * * *